US007606651B2

(12) United States Patent
Kojima et al.

(10) Patent No.: US 7,606,651 B2
(45) Date of Patent: Oct. 20, 2009

(54) APPARATUS FOR CONTROLLING TIMINGS OF INTERVALS IN WHICH COMBUSTION CHAMBER PRESSURE DATA ARE ACQUIRED FROM OUTPUT SIGNALS OF CYLINDER PRESSURE SENSORS OF MULTI-CYLINDER INTERNAL COMBUSTION ENGINE

(75) Inventors: Kazuo Kojima, Nagoya (JP); Hiroshi Haraguchi, Kariya (JP); Youhei Morimoto, Kariya (JP)

(73) Assignee: Denso Corporation, Kariya (JP)

( * ) Notice: Subject to any disclaimer, the term of this patent is extended or adjusted under 35 U.S.C. 154(b) by 133 days.

(21) Appl. No.: 11/947,997

(22) Filed: Nov. 30, 2007

(65) Prior Publication Data

US 2008/0133108 A1 Jun. 5, 2008

(30) Foreign Application Priority Data

Dec. 1, 2006 (JP) ..... 2006-325288

(51) Int. Cl.
*F02D 41/00* (2006.01)

(52) U.S. Cl. ..... 701/102; 701/111; 123/435; 123/198 DB

(58) Field of Classification Search ..... 701/102, 701/104, 105, 107, 112, 114, 111, 115; 123/198 DB, 123/198 F, 198 D, 435, 436; 60/285
See application file for complete search history.

(56) References Cited

U.S. PATENT DOCUMENTS 5,392,642 A * 2/1995 Tao ..... 73/114.13
5,469,735 A 11/1995 Watanabe
6,073,073 A * 6/2000 Kitamura et al. ..... 701/103
6,425,367 B1 * 7/2002 Hiraya et al. ..... 123/299
6,474,291 B2 * 11/2002 Collins et al. ..... 123/198 DB
6,529,815 B2 * 3/2003 Hawkins et al. ..... 701/104
7,055,492 B2 * 6/2006 Yamaoka et al. ..... 123/295
7,079,936 B2 * 7/2006 Honda ..... 701/102
7,128,048 B2 * 10/2006 Yamoaka et al. ..... 123/305
7,255,090 B2 * 8/2007 Fader et al. ..... 123/435
7,278,396 B2 * 10/2007 Leone et al. ..... 123/431

FOREIGN PATENT DOCUMENTS

JP H07-158499 6/1995

* cited by examiner

*Primary Examiner*—Stephen K. Cronin
*Assistant Examiner*—Johnny H. Hoang
(74) *Attorney, Agent, or Firm*—Nixon & Vanderhye, PC

(57) ABSTRACT

A control apparatus for a multi-cylinder internal combustion engine includes pressure sensors used for acquiring combustion chamber pressure data for each engine cylinder, during each of a series of selection intervals respectively corresponding to that cylinder, with each selection interval corresponding to a specific angular displacement of the crankshaft and having a timing determined with respect to a reference piston position in the corresponding cylinder. The timing of the selection intervals is adjusted in accordance with current conditions of the engine, such as a fuel injection mode, to be appropriate for monitoring combustion conditions in the cylinders.

13 Claims, 18 Drawing Sheets

FIG. 7A
DURING NORMAL ENGINE CONTROL
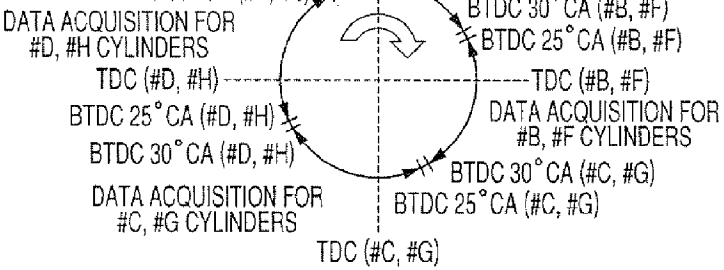
FIG. 7B
DURING DPF REGENERATION CONTROL
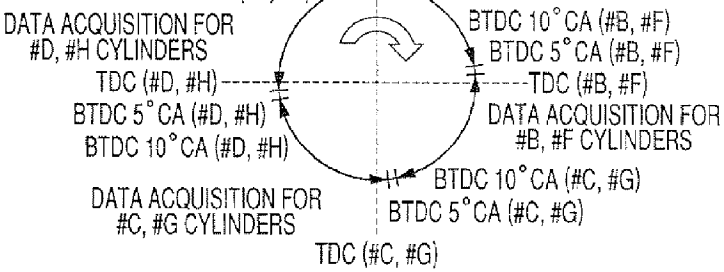
FIG. 7C
DURING POST-INJECTION CHECKING
FIG. 7D
DURING LEARNING PROCESSING

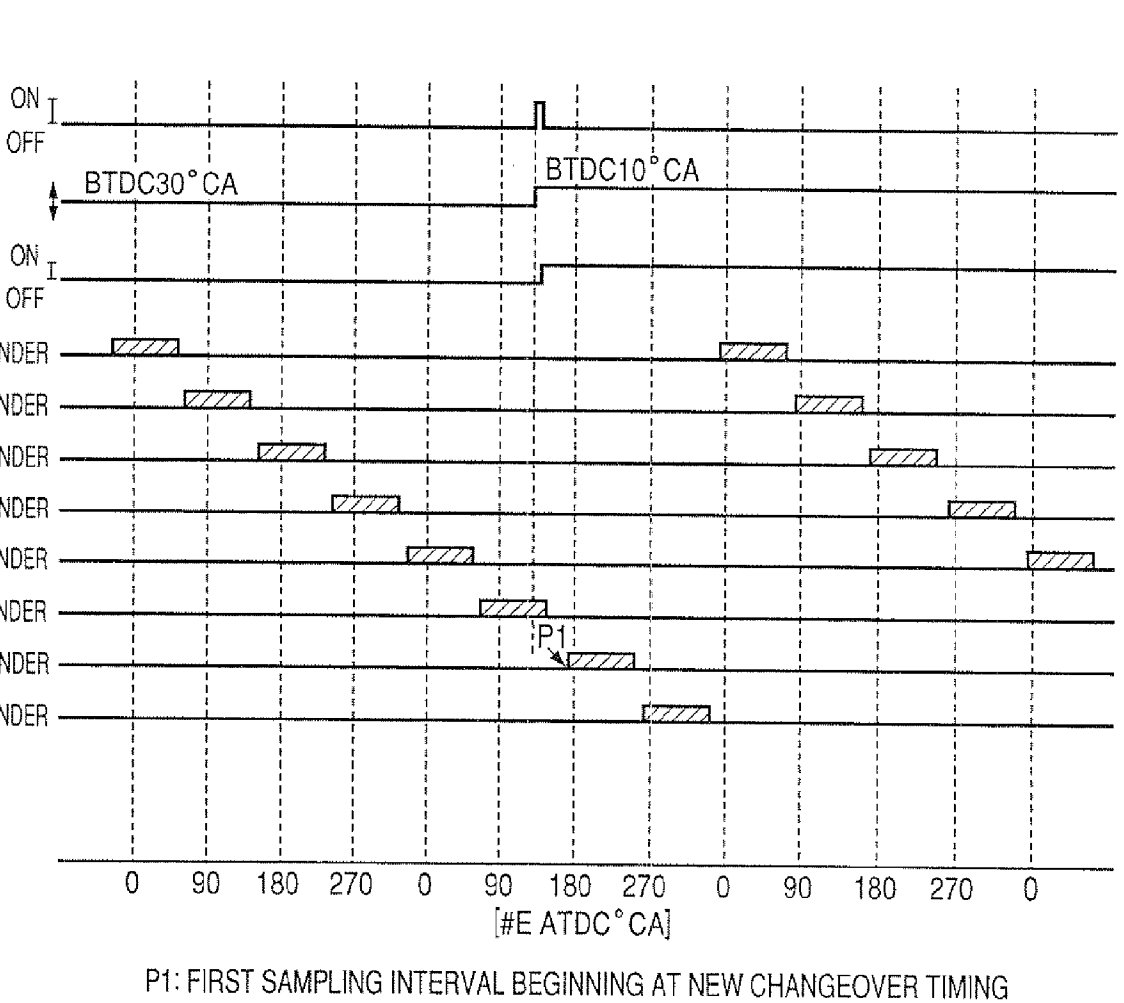
FIG. 10A
REGENERATION CONTROL PREPARATION REQUEST FLAG
ON
OFF
FIG. 10B
REQUESTED SELECTION CHANGEOVER TIMING
BTDC30° CA
BTDC10° CA
FIG. 10C
REGENERATION CONTROL
ON
OFF
FIG. 10D
SAMPLING INTERVALS OF #A CYLINDER
SAMPLING INTERVALS OF #B CYLINDER
SAMPLING INTERVALS OF #C CYLINDER
SAMPLING INTERVALS OF #D CYLINDER
SAMPLING INTERVALS OF #E CYLINDER
SAMPLING INTERVALS OF #F CYLINDER
SAMPLING INTERVALS OF #G CYLINDER
SAMPLING INTERVALS OF #H CYLINDER
P1
0 90 180 270 0 90 180 270 0 90 180 270 0
[#E ATDC° CA]
P1: FIRST SAMPLING INTERVAL BEGINNING AT NEW CHANGEOVER TIMING

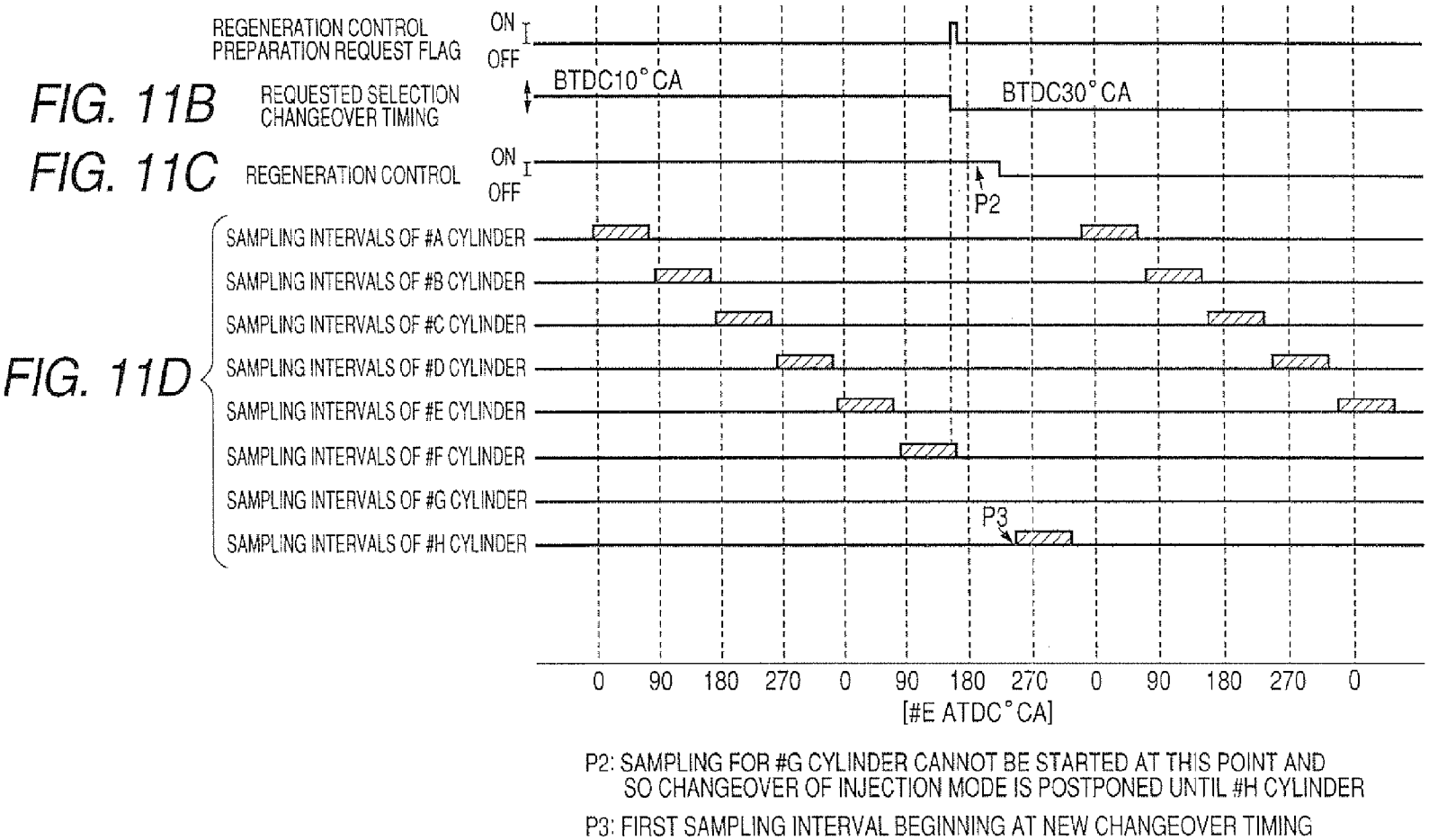
FIG. 11A
REGENERATION CONTROL PREPARATION REQUEST FLAG
ON
OFF
FIG. 11B
REQUESTED SELECTION CHANGEOVER TIMING
BTDC10° CA
BTDC30° CA
FIG. 11C
REGENERATION CONTROL
ON
OFF
P2
FIG. 11D
SAMPLING INTERVALS OF #A CYLINDER
SAMPLING INTERVALS OF #B CYLINDER
SAMPLING INTERVALS OF #C CYLINDER
SAMPLING INTERVALS OF #D CYLINDER
SAMPLING INTERVALS OF #E CYLINDER
SAMPLING INTERVALS OF #F CYLINDER
SAMPLING INTERVALS OF #G CYLINDER
SAMPLING INTERVALS OF #H CYLINDER
P3
0 90 180 270 0 90 180 270 0 90 180 270 0
[#E ATDC° CA]
P2: SAMPLING FOR #G CYLINDER CANNOT BE STARTED AT THIS POINT AND SO CHANGEOVER OF INJECTION MODE IS POSTPONED UNTIL #H CYLINDER
P3: FIRST SAMPLING INTERVAL BEGINNING AT NEW CHANGEOVER TIMING

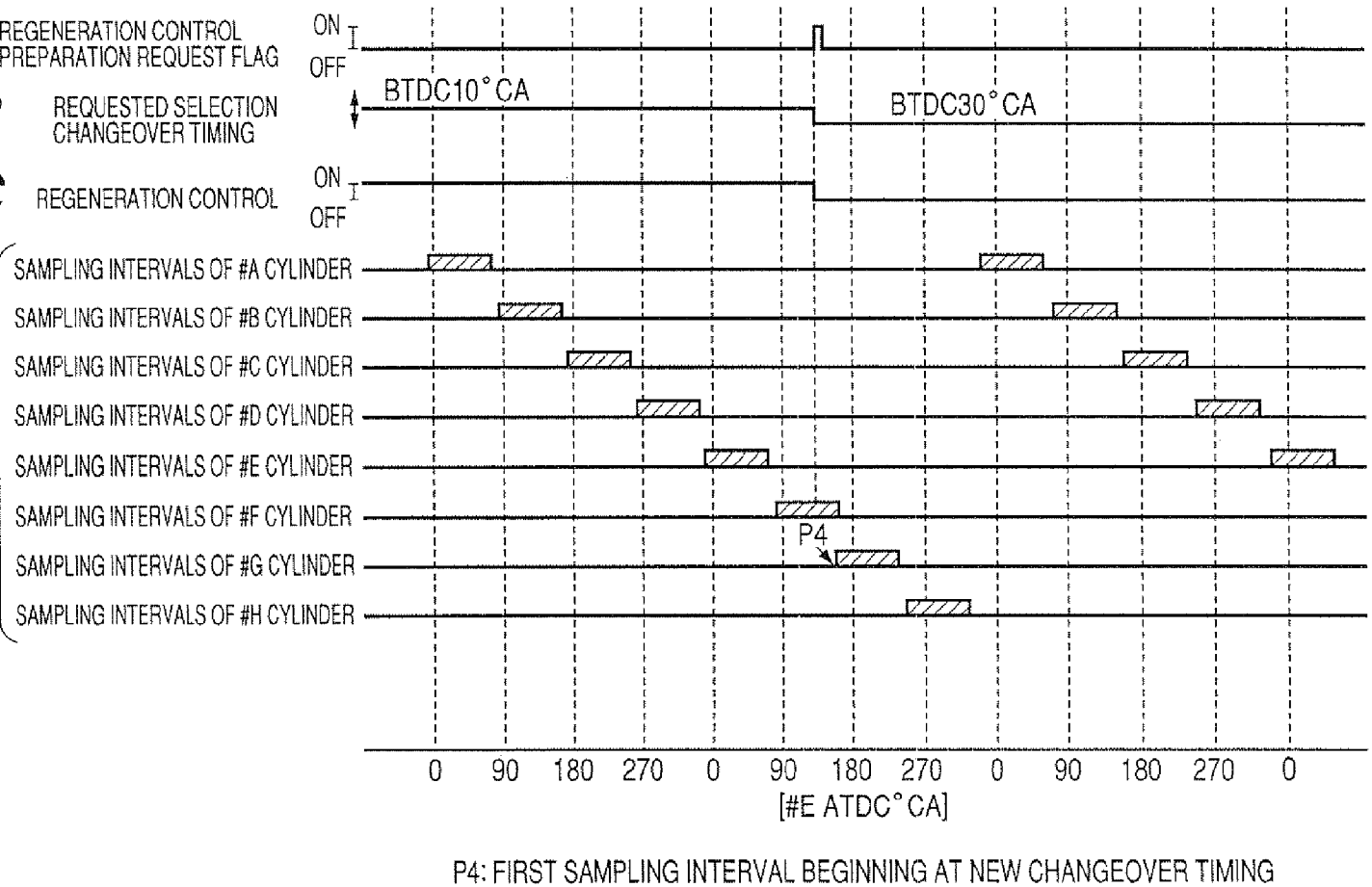
P4: FIRST SAMPLING INTERVAL BEGINNING AT NEW CHANGEOVER TIMING

REGENERATION CONTROL PREPARATION REQUEST FLAG
ON
OFF

REQUESTED SELECTION CHANGEOVER TIMING
BTDC95° CA
BTDC45° CA

REGENERATION CONTROL ESTABLISHMENT FLAG
ON
OFF

SAMPLING INTERVALS OF #A CYLINDER
SAMPLING INTERVALS OF #B CYLINDER
SAMPLING INTERVALS OF #C CYLINDER
SAMPLING INTERVALS OF #D CYLINDER
P5
0
180
360
180
360
180
360
[#A ATDC° CA]

REGENERATION CONTROL PREPARATION REQUEST FLAG
ON
OFF

REQUESTED SELECTION CHANGEOVER TIMING
BTDC45° CA
BTDC95° CA

REGENERATION CONTROL ESTABLISHMENT FLAG
ON
OFF
P6
P7

SAMPLING INTERVALS OF #A CYLINDER
SAMPLING INTERVALS OF #B CYLINDER
SAMPLING INTERVALS OF #C CYLINDER
SAMPLING INTERVALS OF #D CYLINDER
0
180
360
180
270
360
90
180
270
360
[#A ATDC° CA]

REGENERATION CONTROL PREPARATION REQUEST FLAG
ON
OFF

REQUESTED SELECTION CHANGEOVER TIMING
BTDC45° CA
BTDC95° CA

REGENERATION CONTROL ESTABLISHMENT FLAG
ON
OFF

SAMPLING INTERVALS OF #A CYLINDER
SAMPLING INTERVALS OF #B CYLINDER
SAMPLING INTERVALS OF #C CYLINDER
SAMPLING INTERVALS OF #D CYLINDER
P8
0
180
360
180
270
360
90
180
270
360
[#A ATDC° CA]

APPARATUS FOR CONTROLLING TIMINGS OF INTERVALS IN WHICH COMBUSTION CHAMBER PRESSURE DATA ARE ACQUIRED FROM OUTPUT SIGNALS OF CYLINDER PRESSURE SENSORS OF MULTI-CYLINDER INTERNAL COMBUSTION ENGINE

CROSS-REFERENCE TO RELATED APPLICATIONS

This application is based on and incorporates herein by reference Japanese Patent Application No. 2006-325288 filed on Dec. 1, 2006.

BACKGROUND OF THE INVENTION

1. Field of Application

The present invention relates to an apparatus for controlling the timings of intervals in which combustion chamber pressure data are acquired based on output signals from cylinder pressure sensors that detect pressure within respective combustion chambers of a multi-cylinder internal combustion engine, and for controlling operating parameters of the engine based on the acquired data.

2. Description of Related Art

A related type of control apparatus is described for example in Japanese patent No. 2893233, designated in the following as reference document 1, whereby the combustion conditions within respective cylinders of a 4-cylinder internal combustion engine are judged based on output signals from four cylinder pressure sensors, with each sensor detecting the combustion chamber pressure within a corresponding one of the cylinders. With such a system in which respective cylinder pressure sensors are provided for each of the cylinders, the greater the number of cylinders, the greater will be the amounts of data obtained from the sensor signals. Thus, if data expressing the pressure detection results are obtained and processed continuously for each of the cylinders, the processing load on an electronic apparatus such as a microcomputer which operates on the data will increase in accordance with an increase in the number of cylinders.

To overcome this, it is possible to apply multiplexing to the output signals from the cylinder pressure sensors. However in that case, the greater the number of cylinders, the shorter will be the amount of time for which data can be acquired from the cylinder pressure sensor signal of any one cylinder (i.e., within each four-stroke cycle of that cylinder).

Furthermore in recent years, use of exhaust gas purification devices such as a DPF (diesel particulate filter) have come into widespread use in the exhaust systems of diesel engines. Such an exhaust gas purification device can be regenerated when necessary, by temporarily modifying the combustion conditions of the engine. This is basically achieved by delaying the timing of combustion in each cylinder by a specific amount, i.e., with respect to the compression-stroke TDC (top dead center) timing for the cylinder.

More specifically, when the engine operation is controlled to effect such regeneration of an exhaust gas cleansing device, fuel injection is performed such that combustion continues in each cylinder for a substantially long duration following the compression-stroke TDC timing. To ensure this, a small amount of fuel is injected into the cylinder in a pilot injection, prior to a main injection of fuel at a TDC timing, and similar small amounts are injected (as post-injections) after the main injection. Thus it is necessary to monitor the combustion condition within each cylinder during a substantially long range of crank angle variation, at each combustion stroke.

Hence even in the case of an engine having only a small number of cylinders, if multiplexing is applied to the cylinder pressure sensor signals so that data can only be acquired periodically from each cylinder pressure sensor during a small range of crank angle variation, it becomes difficult to adequately monitor the combustion conditions within the cylinders while engine control for regeneration of an exhaust gas purification device is in progress.

SUMMARY OF THE INVENTION

It is an objective of the present invention to overcome the above problem, by providing a control apparatus for a multi-cylinder internal combustion engine that is provided with cylinder pressure sensors for detecting combustion chamber pressure values within each of a plurality of cylinders of the engine, whereby the control apparatus can effectively acquire digital data from the detection results, for use in controlling operating parameter of the engine (e.g., output torque, speed) even when the engine has a large number of cylinders.

It should be noted that the term "internal combustion engine" as used herein refers to a four-stroke internal combustion engine.

Basically, a control apparatus according to the present invention comprises a plurality of cylinder pressure sensors respectively provided for at least part of the cylinders of the engine, and processing circuitry (e.g., implemented as a microcomputer) which acquires digital data from detection signals of the sensors, as information representing pressure conditions in the combustion chambers of the engine, and thereby monitors the combustion conditions in the cylinders. Specifically, the processing circuitry acquires the digital data for each cylinder during each of a corresponding series of angular regions, which are part of a continuous non-overlapping sequence of such angular regions, where the term "angular region" is used herein to refer to an interval corresponding to a specific amount of angular displacement of the engine output shaft (crankshaft). It can thus be understood that each angular region is part of a specific series that corresponds to a specific cylinder.

A control apparatus according to the present invention is characterized in comprising timing adjustment circuitry (e.g., implemented as a microcomputer) which sets the timings of the angular regions in accordance with an operating condition of the engine, where the term "timing" of an angular region is used herein to refer to the timing of the start of the angular region.

When the output signals from respective cylinder pressure sensors of an internal combustion engine having a plurality of cylinders are operated on as a continuous sequence, by being multiplexed, the size of each angular region is reduced in accordance with increase in the number of engine cylinders. For example, in the case of an 8-cylinder 4-stroke engine, the extent of each angular region is only 720/8° CA (i.e., 720/8 degrees of crankshaft rotation), that is to say, 90° of crankshaft rotation. Hence with such an engine, it is impossible for example to use the output signals from the cylinder pressure sensors to monitor each combustion chamber during the complete 180° CA extent of each combustion stroke.

However with the present invention, the timing of each angular region (and hence, of each interval in which the conditions within a combustion chamber are monitored during each combustion stroke) can be adjusted to be optimized for the specific current operating condition of the engine. That is to say, the timing can be adjusted such that each interval in which combustion is actually occurring can be monitored, irrespective of the fact that only a part of the entire combustion stroke can be monitored, and irrespective of the fact that the timing of combustion will vary in accordance with the engine operating conditions.

Hence it is a basic advantage of the invention that more effective monitoring of the combustion conditions within the engine combustion chambers can be achieved, for an internal combustion engine having a large number of cylinders.

In general, such cylinder pressure sensors produce analog sensor signals, and such a control apparatus preferably comprises a single A/D (analog to digital) converter circuit, a signal selector circuit such as a multiplexer, and timing adjustment circuitry (e.g., implemented as a microcomputer) which controls the signal selector circuit. The timing adjustment circuitry selects successive ones of the analog sensor signals during respective selection intervals, which correspond to respective angular regions. That is to say, the start of each angular region occurs in synchronism with a signal sampling interval changeover timing, at which the cylinder pressure sensor signal for the next cylinder in the firing sequence is selected for A/D conversion. Successive sets of digital data are thereby acquired, corresponding to respective cylinders of the engine.

By using a single A/D converter in common for all of the engine cylinders in that way, the amount of hardware required to implement the control apparatus can be reduced, by comparison with providing separate A/D converters for each of the cylinders. However the invention can be equally applied to a system in which respective A/D converters are provided for each of the cylinder pressure sensors, in which case the outputted digital signals from the A/D converters would be multiplexed, i.e., successively selected in intervals corresponding to respective angular regions.

As applied to a fuel injection type of internal combustion engine, which can operating in a plurality of different fuel injection control modes (having respectively different timings of injection of fuel), the timing adjustment circuitry sets the timing of each of the data acquisition ranges in accordance with the fuel injection control mode that is currently being applied.

Hence, since the timing of each angular region can be adjusted in accordance with the timing at which fuel is injected into a combustion chamber, the combustion condition within the combustion chamber during each interval of combustion can be effectively monitored.

In particular, the invention is applicable to a multi-cylinder internal combustion engine having an exhaust gas cleansing device installed in the engine exhaust system, such as a DPF (diesel particulate filter) of a diesel engine, in which the fuel injection control circuitry establishes various fuel injection modes, such as a normal fuel injection mode during normal operation of the engine, and also establishes a regeneration control mode when regeneration of the DPF is to be performed. In the regeneration control mode the timings of fuel injections are delayed, by comparison with the normal fuel injection mode, such as to produce combustion conditions that will result in regeneration of the DFP as described hereinabove. With the present invention, the timing adjustment circuitry selectively alters the timing of the angular regions in accordance with whether or not the regeneration control mode is established. In that way, the combustion conditions in the cylinders during operation in the regeneration control mode can be suitably monitored.

Furthermore, during operation in the regeneration control mode, after a main fuel injection (to produce engine torque) has occurred in a combustion stroke, one or more subsequent smaller fuel injections (post-injections) are performed, that are substantially delayed with respect to the main fuel injection timing.

For that reason, when the invention is applied to an internal combustion engine for which regeneration control can be applied, while the regeneration control mode is established, the timing adjustment circuitry mainly sets the angular region timing at a first value (which is appropriate for monitoring the combustion condition resulting from the main injection), but sporadically changes the angular region timing to a second value, which is delayed with respect to the first timing, and so is appropriate for monitoring the combustion condition resulting from the post-injections.

In that way it becomes possible to effectively monitor combustion conditions in the cylinders during operation in the regeneration control mode. This is achieved in spite of the fact that the extent of each angular region is only a fraction of the extent of a combustion stroke, while during operation in the regeneration control mode, combustion occurs during a substantially long part of each combustion stroke.

Preferably, when a change is to be made to a new fuel injection control mode, necessitating a change in value of the angular region timing, the new fuel injection mode and the new angular region timing are applied concurrently. In that way, an interval of unstable combustion conditions that may occur immediately following a change to a new fuel injection mode can be effectively monitored.

It is possible that when a change is to be made to a new fuel injection control mode, the angular region timing which is required for use in the new fuel injection control mode is advanced with respect to the currently established angular region timing. In such a case, it is necessary to prevent overlap between two successive angular regions of respective cylinders. Hence the fuel injection control circuitry and the timing adjustment circuitry are preferably configured whereby, when such a condition arises, the new fuel injection control mode and the new angular region timing are each initiated beginning from the cylinder which is the next after the immediately succeeding cylinder (i.e., immediately succeeding the cylinder whose sensor signal is currently selected) in the firing sequence.

From another aspect, the control apparatus may include learning processing circuitry (e.g., implemented by a microcomputer) for performing processing to learn the respective deviations of the output characteristics of the cylinder pressure sensors. In that case, the timing adjustment circuitry is preferably configured to selectively alter the timings of the angular regions in accordance with whether or not the learning processing is being performed.

In that way, each the timing of each interval (crank angle region) in which the output signal from a cylinder pressure sensor is monitored (to obtain information for use in the learning processing) can be optimally adjusted. In general, when learning processing is in progress, the timings of the angular regions should be delayed, by comparison with the timings when learning processing is not being performed.

The above and other aspects of the invention are described in greater detail in the following, referring to specific embodiments.

BRIEF DESCRIPTION OF THE DRAWINGS

FIGS. 7A, 7B, 7C and 7D are diagrams illustrating crank angle ranges constituting angular regions, with the first embodiment;

FIGS. 10A, 10B, 10C and 10D are timing diagrams for describing changing of the fuel injection mode and corresponding changing of the sampling interval changeover timing, with the first embodiment;

FIGS. 11A, 11B, 11C and 11D are timing diagrams corresponding to FIGS. 10A, 10B, 10C and 10D for describing operation when a new sampling interval changeover timing is more advanced than a currently applied sampling interval changeover timing;

FIGS. 12A, 12B, 12C and 12D are timing diagrams corresponding to FIGS. 10A, 10B, 10C, and 10D for describing another example of operation when a new sampling interval changeover timing is more advanced than a currently applied sampling interval changeover timing;

FIGS. 18A, 18S, 18C and 18D are timing diagrams corresponding to FIGS. 17A, 17B, 17C and 17D for describing operation when a new sampling interval changeover timing is advanced with respect to a currently applied sampling interval changeover timing, with the second embodiment, and, FIGS. 19A, 19B, 19C and 19D are timing diagrams corresponding to FIGS. 17A, 17B, 17C and 17D for describing another example of operation when a new sampling interval changeover timing is more advanced than a currently applied sampling interval changeover timing, with the second embodiment.

DESCRIPTION OF PREFERRED EMBODIMENTS

Figure 1:
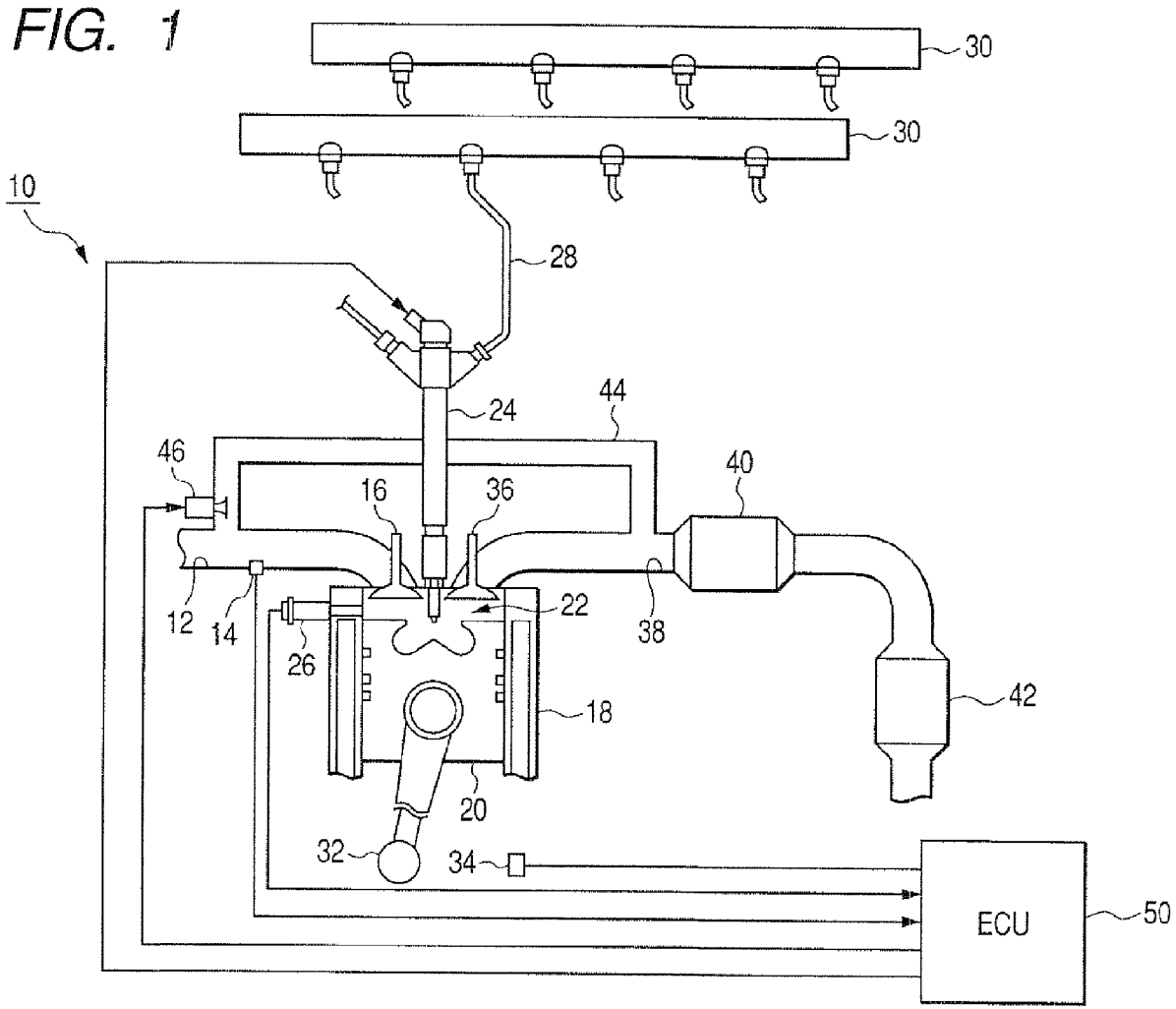
FIG. 1 shows the overall configuration of a first embodiment of an engine system.

A first embodiment will be described in the following, which is incorporated in an engine system formed of a fuel injection control apparatus and a common-rail type of diesel engine of a vehicle. FIG. 1 shows the overall configuration of the engine system (with only one of the cylinders being illustrated), in which an 8-cylinder diesel engine 10 has an intake manifold 12 that is provided with an intake pressure sensor 14 for detecting the pressure within the intake manifold 12. Each of the cylinders has an identical configuration to that shown in FIG. 1. The intake manifold 12 communicates via a intake valve 16 with a combustion chamber 22 of the cylinder, with the combustion chamber 22 being formed between a cylinder block 18 and a piston 20 of the cylinder. A tip portion of a fuel injector 24 protrudes into the combustion chamber 22, for injecting controlled amounts of fuel into the combustion chamber 22. A cylinder pressure sensor 26 has a portion thereof exposed to the interior of the combustion chamber 22, for enabling the cylinder pressure sensor 26 to detect the pressure within the combustion chamber 22 and produce a corresponding sensor signal. In the case of a glow plug type of diesel engine, it would be possible to integrate the cylinder pressure sensor 26 with the glow plug.

The fuel injector 24 is controlled by the ECU 50 to inject fuel that is supplied from a common rail 30 via a high-pressure fuel pipe 28. Fuel is injected into the combustion chamber 22 at each of respective timings when there is a high level of pressure and temperature within the combustion chamber 22, causing self-ignition of the fuel, thereby generating energy for driving the piston 20 to rotate a crankshaft 32 of the diesel engine 10. A crank angle sensor 34 is disposed adjacent to the crankshaft 32, for detecting the angle to which the crankshaft 32 is rotated, i.e., the crank angle. For each cylinder, the crank angle varies through 720° in each four-stroke cycle of the piston. With respect to each cylinder, crank angle values are expressed in relation to the compression-stroke TDC position for that cylinder, with the crank angle corresponding to that TDC position being designated as "0° TDC".

After combustion has occurred in a combustion stroke, the exhaust valve 36 is opened and exhaust gas then exits from the combustion chamber 22 to the exhaust pipe 38 in an exhaust stroke. As shown, a DPF 40 is disposed within the exhaust pipe 38 as an exhaust gas purification device which acts by catalytic oxidation, and a NOx absorption catalyst 42 is also disposed in the exhaust pipe 38 for removing nitrous oxides from the exhaust gas.

The part of the exhaust pipe 38 upstream from the DPF 40 communicates with the intake manifold 12 via an EGR (exhaust gas recirculation) passage 44. The cross-sectional area of the flow path in the EGR passage 44 is adjusted by an EGR valve 46, for thereby recirculating some exhaust gas from the DPF 40 to the intake manifold 12, with the amount of recirculated exhaust gas being controlled by means of the EGR valve 46.

An ECU 50 controls the operation of the fuel injector 24 and of various actuators including the EGR valve 46, based on output signals from various sensors (not shown in the drawings, other than the cylinder pressure sensor 26) of the engine system, for thereby controlling the output torque and rotation speed of the diesel engine 10.

Figure 2:
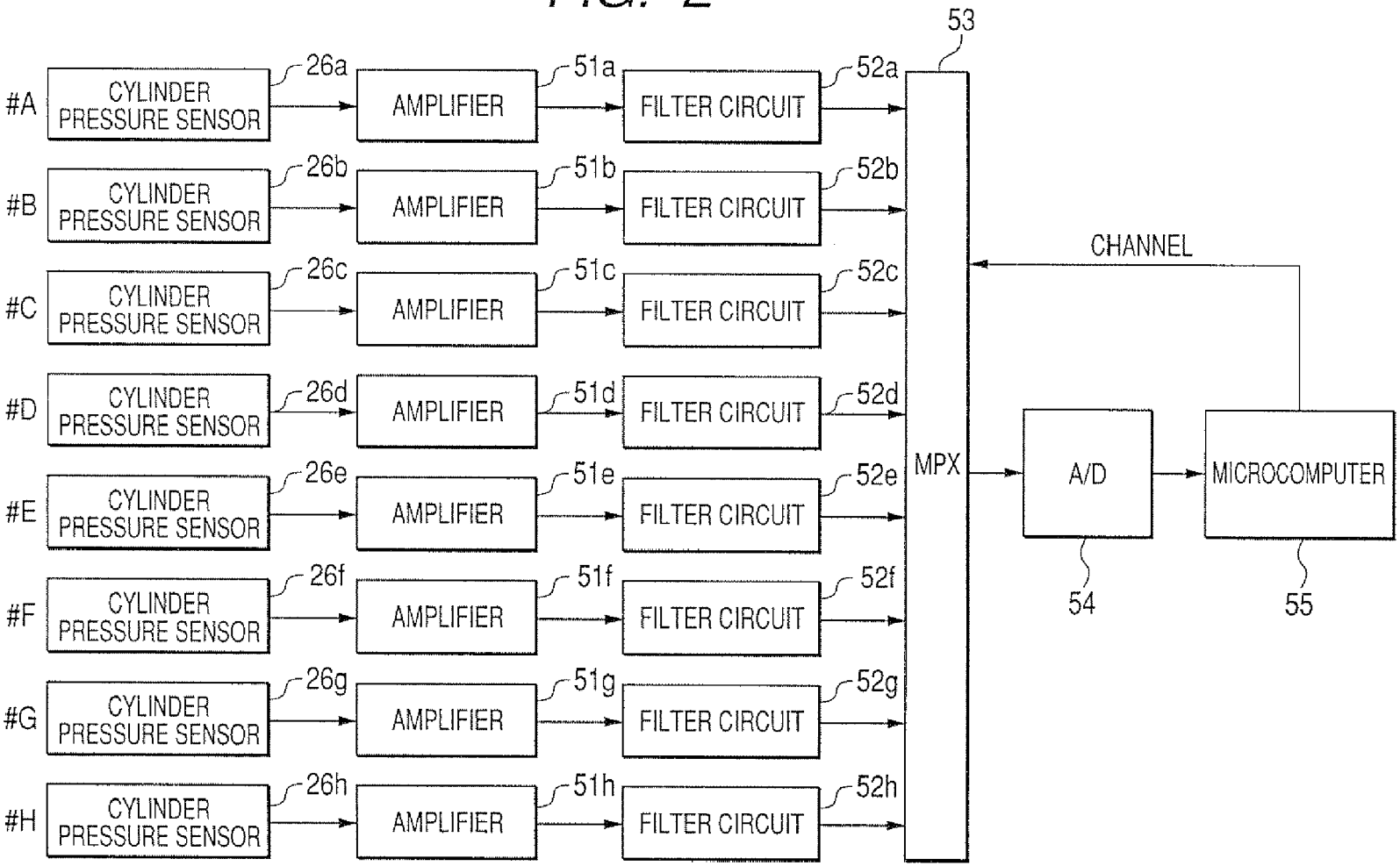
FIG. 2 is a block diagram showing the internal configuration of an ECU (electronic control unit) of the first embodiment.

FIG. 2 is a block diagram illustrating the internal configuration of the ECU 50, in which output signals from a set of eight cylinder pressure sensors 26*a* to 26*h*, respectively corresponding to the #A to #H cylinders of the diesel engine 10 (with the firing sequence of the engine being from the #A to #H cylinder) are supplied to respectively corresponding ones of a set of eight amplifiers 51*a* to 51*h*. The ECU 50 also includes a set of eight filter circuits 52*a* to 52*h* which receive respective output signals from the amplifiers 51*a* to 51*h*, with each signal varying in accordance with the combustion chamber pressure in the corresponding one of the #A to #H cylinders. The filter circuits 52*a* to 52*h* are respective hardware devices, which remove noise from the amplified sensor signals. A multiplexer 53 selects one of these output signals, to be inputted to an A/D converter 54. A microcomputer 55 generates a channel changeover signal which controls the multiplexer 53, to determine the duration and timings for which each filter output signal is selected to be supplied to the A/D converter 54 to be sampled thereby, with digitized sample values being supplied to the microcomputer 55. The microcomputer 55 thereby derives digital data from each of the output signals of the cylinder pressure sensors 26*a* to 26*h*.

Figure 3A:
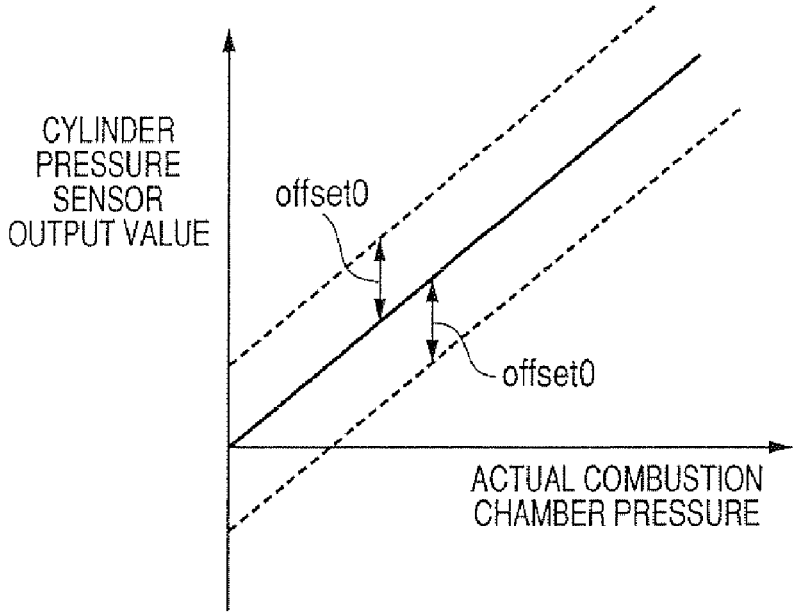
FIGS. 3A and 3B illustrate an offset deviation in an output signal of a cylinder pressure sensor.

One of the functions of the ECU 50 is to perform learning processing, for learning (i.e., evaluating, and storing the evaluation results) deviation in the respective output characteristics of the cylinder pressure sensors 26*a* to 26*h*. This learning processing is described in the following, referring first to FIGS. 3A, 3B, which show examples of such deviations in characteristics. FIG. 3A illustrates examples of an offset (indicated by the broken-line characteristics) which can arise in the output characteristic (sensor output signal level versus cylinder internal pressure) of a cylinder pressure sensor, in relation to the actual variation of pressure within the cylinder, with the latter shown as the full-line characteristic.

Figure 3B:
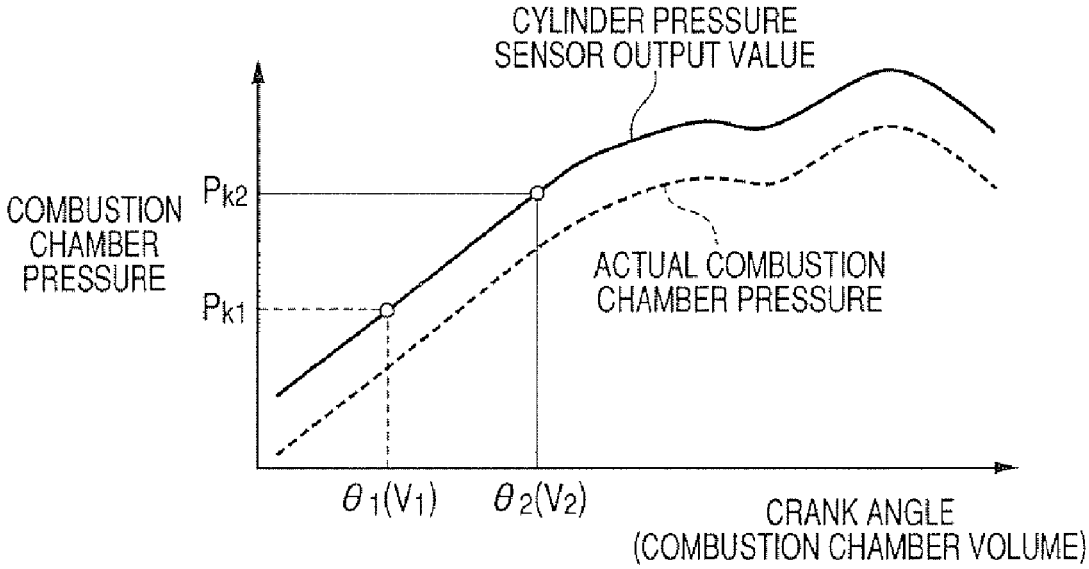

FIG. 3B illustrates the relationship between cylinder internal pressure and crank angle values during a compression stroke, with the broken-line characteristic showing the actual pressure variation and the full-line characteristic illustrating the corresponding pressure values as represented by the output signal from the cylinder pressure sensor, when there is an offset in the output characteristic of the sensor.

Figure 4A:
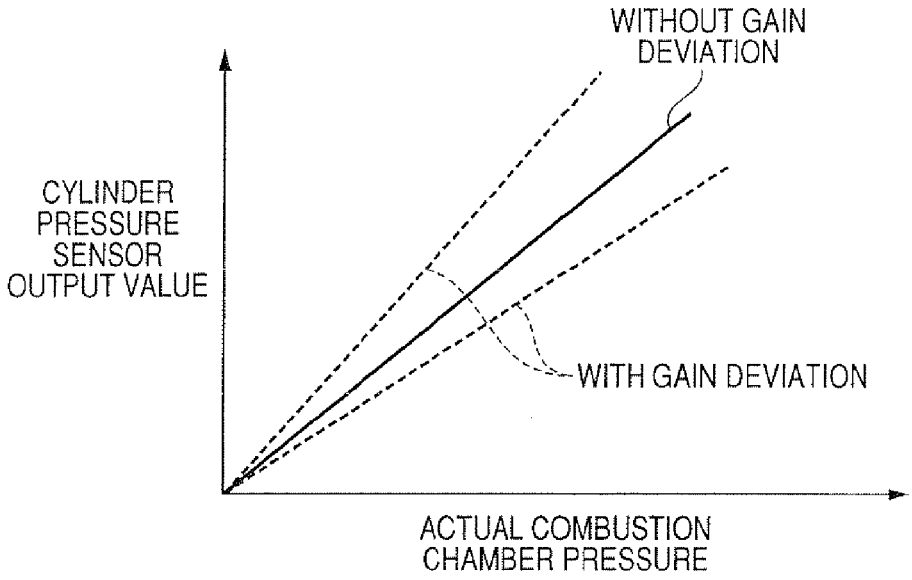
FIGS. 4A and 4B illustrate a gain deviation in an output signal of a cylinder pressure sensor.

FIG. 4A illustrates the relationship between cylinder internal pressure and output signal level from a cylinder pressure sensor, with the full-line characteristic showing the variation in the case of absence of gain deviation of the sensor, and with the broken-line characteristics showing examples of the effects of gain deviation.

Figure 4B:
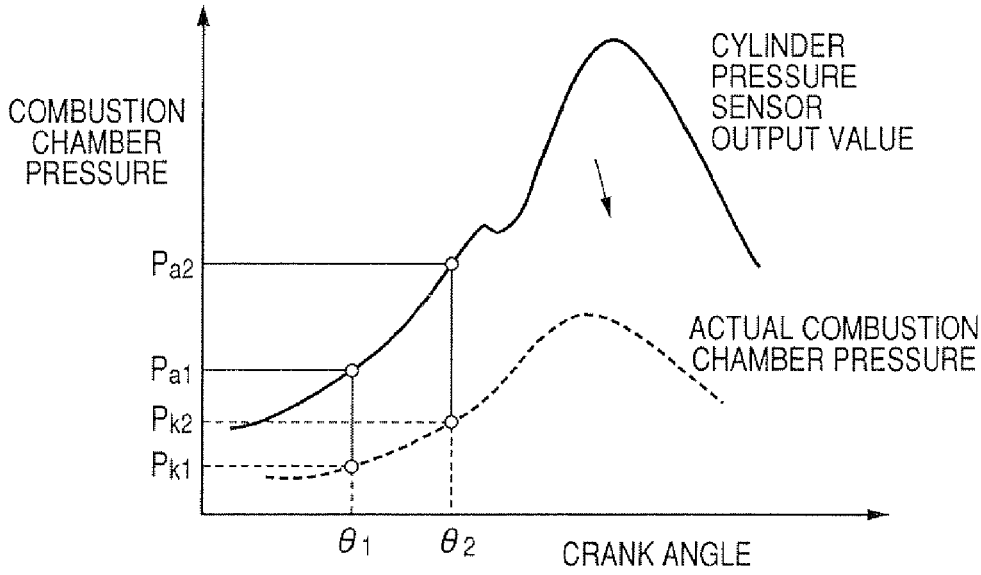

FIG. 4B illustrates the relationship between cylinder internal pressure and crank angle values during a compression stroke, with the broken-line characteristic showing the actual pressure variation and the full-line characteristic illustrating the corresponding pressure values as represented by the output signal from the cylinder pressure sensor, when there is a gain deviation of the sensor.

Figure 5:
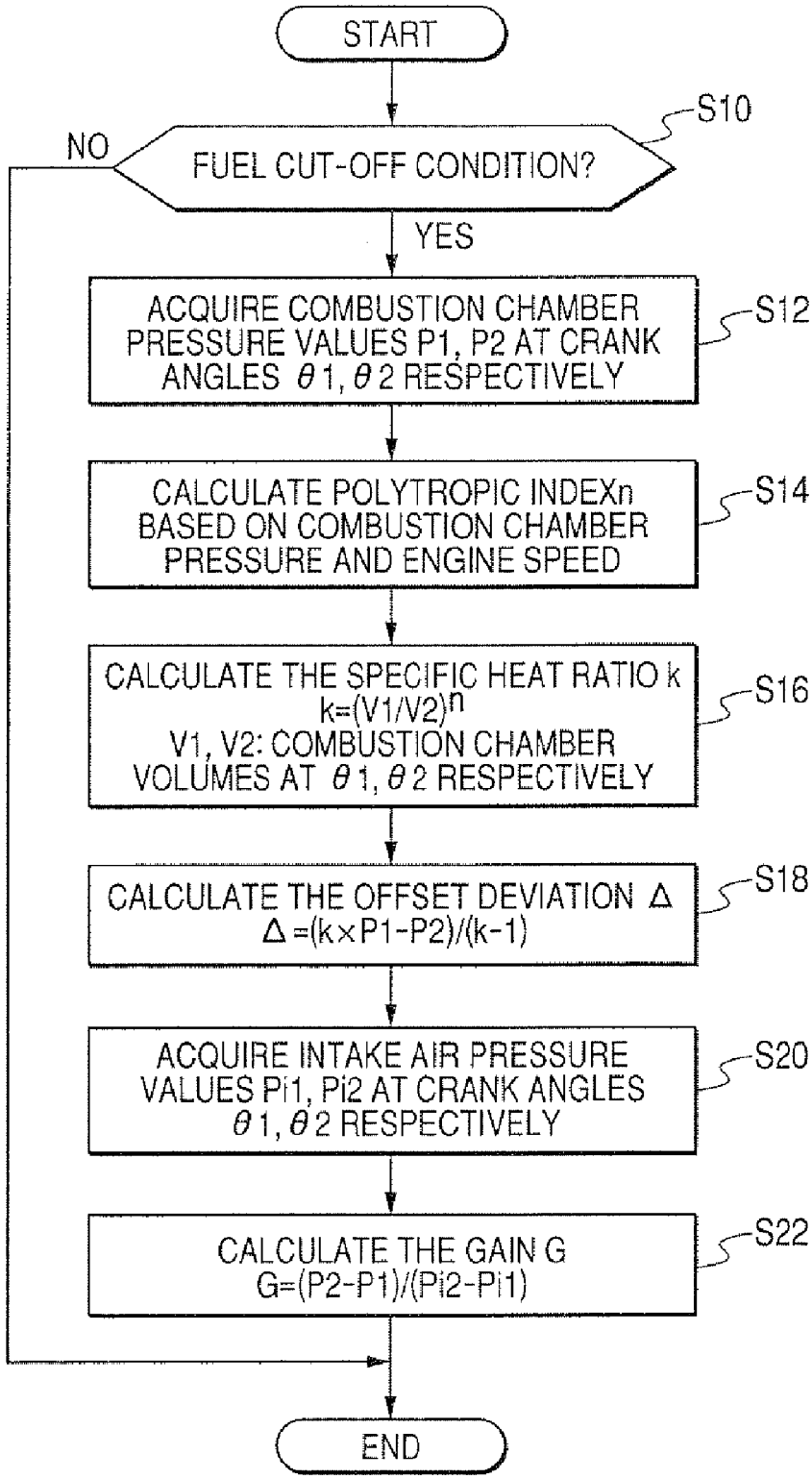
FIG. 5 is a flow diagram of a processing routine executed by a microcomputer of the first embodiment, for performing processing to learn the deviations in output characteristics of cylinder pressure sensors.

FIG. 5 is a flow diagram of a processing routine that is executed by the ECU 50 for learning the values of the above-described offset and gain deviation of a cylinder pressure sensor. This is executed repetitively at fixed intervals, for each of the cylinder pressure sensors 26*a* to 26*h*, by the ECU 50. In this processing, firstly in step S10 a decision is made as to whether the engine is operating in a fuel cut-off condition, i.e., is running, but without fuel injection being currently performed. This decision is made to determine whether the engine is operating in a suitable condition for executing processing to learn the characteristics of a cylinder pressure sensors. If the engine is found to be in the fuel cut-off condition, then S12 is executed in which two detected cylinder (internal) pressure values P1, P2 (i.e., as obtained from the cylinder pressure sensor output during a compression stroke) corresponding to respective crank angles θ1, θ2 are acquired. As shown in FIGS. 3A, 3B, these two crank angle values θ1 and θ2 correspond to the two cylinder internal pressure values Ps1, Ps2 respectively, occurring in the combustion chamber of the cylinder for which learning processing is being performed.

With this embodiment the values of θ1 and θ2 satisfy the relationship [BTDC 75° CA≦θ1<θ2≦TDC]. The reason for this is that substantial variations in the cylinder internal pressure occur after the piston passes the BTDC 75° position during a compression stroke.

Next in step 514, a polytropic index value n is calculated based on the speed of rotation of the crankshaft 32 and the cylinder internal pressure. Here, the average of the values P1 and P2 can be used as the cylinder internal pressure value, or alternatively, a larger number of sample values of cylinder internal pressure can be obtained during the crank angle range from θ1 to θ2, and the average of these used in calculating the polytropic index n. Next in step S16, the specific heat ratio k is calculated based on the respective volumes of the combustion chamber 22 at the crank angle values θ1 and θ2 and on the polytropic index n.

Step S18 is then executed, in which the amount of offset deviation Δ is calculated by using the following equation:

$$\Delta=(k\times P1-P2)/(k-1)$$

Next in step S20, the respective values of the intake air pressure Pi1, Pi2 occurring at the crank angles θ1, θ2 are acquired, and in step S22 the gain G of the sensor is calculated from the following equation:

$$G=(P2-P1)/(Pi2-Pi1)$$

If there is a NO decision in step S10, or if the processing of step S22 has been completed, this execution of the routine is ended.

The deviations in the output characteristic of a cylinder pressure sensor are thereby learned, with that information being subsequently used to correct the values of cylinder internal pressure that are obtained from the output signal of that sensor. High accuracy of detecting cylinder internal pressure can thereby be achieved.

As shown in FIG. 2 above, with this embodiment the A/D converter 54 is used in common for each of the #A to #H cylinders. Thus the extent of the angular region within which cylinder internal pressure data can be acquired for a cylinder, during each four-stroke cycle, is relatively short. Specifically, the maximum extent corresponds to 720/8° CA. Thus a problem arises as to whether a cylinder pressure sensor output signal can be acquired to a sufficient degree within this angular region.

Figures 6A, 6B, 6C:
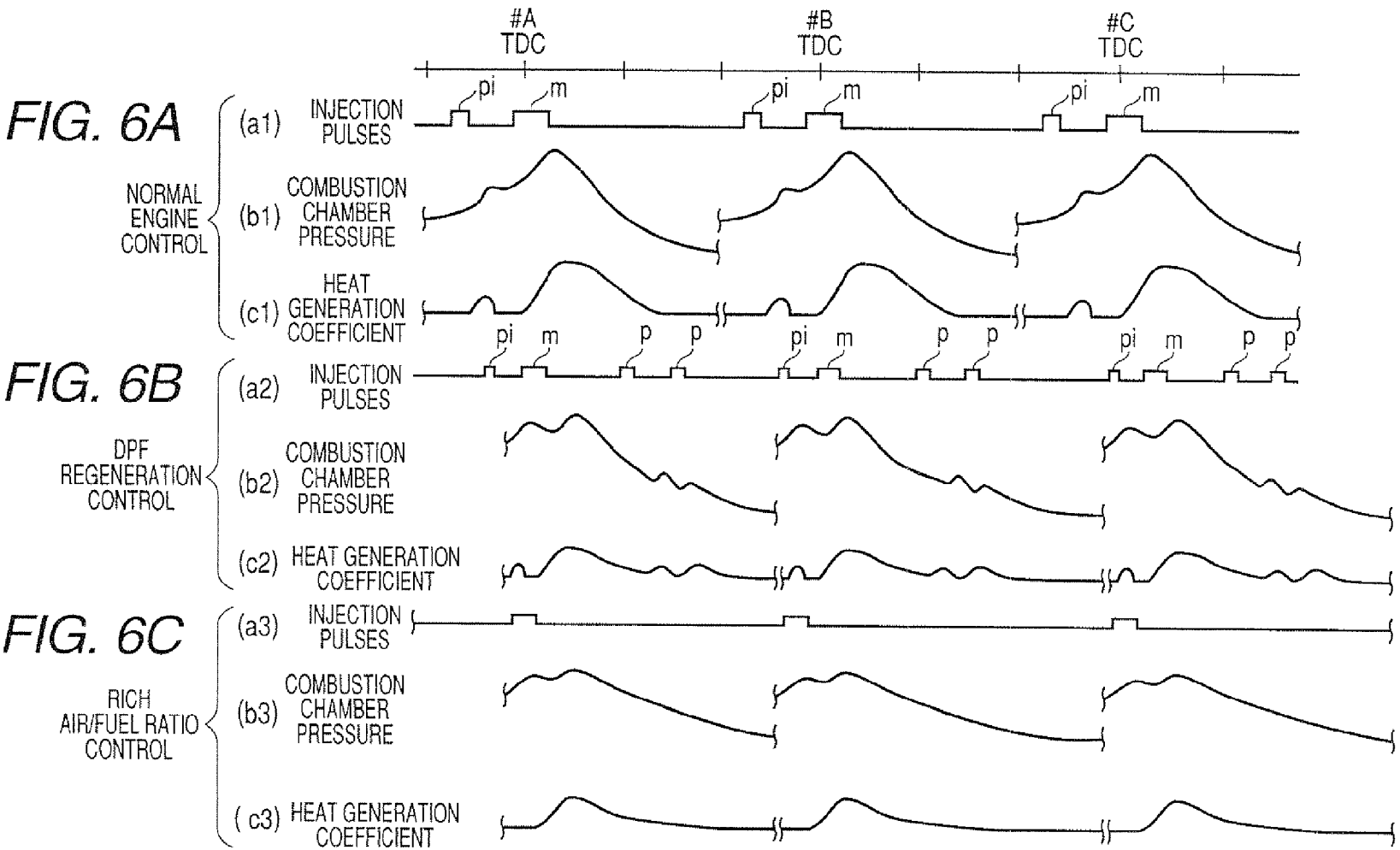
FIGS. 6A, 6B and 6C are timing diagrams for describing respective fuel injection control modes of the first embodiment.

FIG. 6A shows fuel injection timings of successively fired cylinders (#A, #B, #C cylinders), the corresponding changes occurring in cylinder internal pressure, and the corresponding changes in heat generation coefficient (calculated based on the cylinder internal pressure), for the case of normal operation of the engine. FIG. 6B shows the changes in the above parameters when engine control is being applied for DPF regeneration, and FIG. 6C shows the changes in the above parameters when the engine is running with a rich air/fuel ratio.

With this embodiment as shown in FIG. 6A, during normal operation of the engine, a pilot injection (pi) of a small amount of fuel is performed immediately before main combustion occurs, i.e., before the compression-stroke TDC point is reached and the main injection (m) is performed. The pilot injection is performed in order to more effectively mix air and fuel and thereby achieve more rapid combustion when the main injection occurs. This serves to reduce the amount of nitrous oxides in the resultant exhaust gas, and also to reduce the amount of noise and vibration produced by the engine. The amount of fuel injected as the main injection m is determined upon the output requirements for the diesel engine 10 at the time, i.e., required levels of output torque and crankshaft rotation speed.

When DPF regeneration control is being applied as shown in FIG. 6B, in addition to a pilot injection and a main injection as described above, two other injections of respective small amounts of fuel are performed, after TDC and after the main injection has been completed. These will be referred to as the post-injections p, and serve to control the temperature of the exhaust gas, to achieve regeneration of the DPF 40. Also as shown, during DPF regeneration control, both the pilot injection pi and the main injection m are delayed with respect to their timings during normal operation. As a result of this, the timings at which the heat generation coefficient increases as a result of combustion due to the pilot injection p and the main injection m are correspondingly delayed, by comparison with normal engine control operation. Furthermore as shown by section c3 of FIG. CC, due to the post-injections p, the heat generation coefficient also increases at timings which are substantially delayed from the TDC point.

As illustrated in FIG. 6C, during rich combustion control of the diesel engine 10 (i.e., when the air/fuel ratio is made substantially more rich than during normal fuel injection control, for the purpose of recirculating NOx that has been absorbed by the NOx absorption catalyst 42) the ratio of the EGR amount to the total amount of contents of the combustion chamber 22 (the EGR ratio), is made large. This is done to delay the timing of ignition of the main fuel injection m, by comparison with the timing during normal fuel injection control. As a result, the increase in the heat generation coefficient (due to combustion of the main injection m) is delayed, causing the level of heat generated within a combustion stroke to increase and decrease gradually over a longer interval than is the case for normal fuel injection control.

Hence as can be understood from the combustion chamber pressure and heat generation coefficient waveforms shown FIGS. 6A to 6C, with the extent of each angular region fixed at 720/8° CA for each of the cylinders, if the angular region timing were to be held fixed irrespective of the engine operating condition (and so irrespective of variations in the timings at which combustion occurs during a combustion stroke), it would not be possible to properly monitor the combustion chamber conditions in each cylinder, based on digital data obtained from the A/D conversion.

Furthermore when performing processing for learning the deviations in the output characteristics of the cylinder pressure sensors 26*a* to 26*h*, as described above referring to FIG. 5, it is desirable to sample the output signal from each sensor during an angular region whose timing is substantially advanced from the compression-stroke TDC timing.

Hence with this embodiment as shown in FIGS. 7A to 7C and described in the following, the timing of the angular region is set in accordance with the current running condition of the diesel engine 10. Each of FIGS. 7A to 7C conceptually illustrates a sequence of eight angular regions that occur, for a corresponding cylinder, in two successive rotations of the crankshaft 32.

FIG. 7A illustrates the case of normal fuel injection control of the engine. With the extent of each angular region being 720/8° CA as described above, in the case of normal fuel injection control, the angular region for each cylinder extends from BTDC 30° CA to ATDC 60° CA (with reference to compression-stroke TDC in the corresponding cylinder), i.e., through 90° of crank angle increase. However in the microcomputer 55, the digitized sample values from the A/D converter 54 are subjected to software-based filtering to remove noise, for thereby obtaining digital data that are operated on by the microcomputer 55. Thus each digital data value is obtained from a plurality of successive digitized sample values. For that reason, to ensure that only valid digital data are acquired by the microcomputer 55, the data obtained from the software-based filtering only begin to actually be acquired (processed) by the microcomputer 55 after 5° CA has elapsed from a sampling interval changeover timing, i.e., has elapsed following the start of an angular region. A guard band of 5° is thereby established, to ensure data reliability.

As a result, the timing at which digital data for a cylinder begin to be acquired by the microcomputer 55 begins at BTDC 25° CA instead of at BTDC 30° CA, so that the crank angle range within which digital data are actually acquired for each cylinder extends from BTDC 25° CA to ATDC 60° CA during normal fuel injection control. Such a part of an angular region will be referred to as the data acquisition range in that angular region.

As shown in FIG. 7B, in the case of engine operation during DPF regeneration control, the A/D converter 54 changes over from A/D conversion of the cylinder pressure sensor signal for one cylinder to conversion of the sensor signal for the succeeding cylinder at a point BTDC 10° CA (with reference to the compression-stroke TDC of that succeeding cylinder), i.e., at the start of the next angular region. Thus in this case, the angular region for each cylinder extends from BTDC 10° CA to ATDC 80° CA, and due to the aforementioned guard band, the data acquisition range extends from BTDC 5° CA to ATDC 80° CA. Thus in this case, each angular region is delayed, by comparison with the normal fuel injection control illustrated in FIG. 7A.

Hence, as can be understood from FIG. 6B above, during DPF regeneration control operation, data are acquired by the microcomputer 55 (at each combustion stroke) during an appropriate interval for monitoring the combustion conditions.

When the post-injections are performed during DPF regeneration control, since (as shown in FIG. 6B above) this occurs at timings substantially delayed from TDC, it would be difficult to accurately evaluate the fuel combustion conditions during these post-injections by using the data acquisition range of FIG. 7B. Hence, when monitoring combustion conditions during post-injection, the data acquisition range and angular region timings are changed from those of FIG. 7B to those shown in FIG. 7C. In this case, the angular region is from ATDC 20° CA to ATDC 110° CA, so that the data acquisition range is from ATDC 25° CA to ATDC 110° CA. By thus substantially delaying the data acquisition range with respect to TDC, the combustion conditions (cylinder internal pressure variations) during the post-injections can be suitably monitored by the microcomputer 55.

As shown in FIG. 7D, when processing is being executed for learning the deviations in the respective output characteristics of the cylinder pressure sensors 26*a* to 26*h*, the A/D converter 54 changes over from A/D conversion of the cylinder pressure sensor signal for one cylinder to conversion of the sensor signal for the immediately succeeding cylinder at BTDC 80° CA (with reference to the compression-stroke TDC of that succeeding cylinder). To monitor the combustion chamber pressure values during execution of the learning processing, a suitable (sufficient) angular region is from BTDC 80° Ca to TDC, i.e., an angular region extent of 80° CA. However it is preferable that the extent of the angular regions be held unchanged, and so each angular region in this case is set as 720/8° CA, i.e., extending from BTDC 80° CA to ATDC 10° CA. Hence due to the aforementioned guard band, the data acquisition range extends from BTDC 75° CA to ATDC 10° CA.

Figure 8:
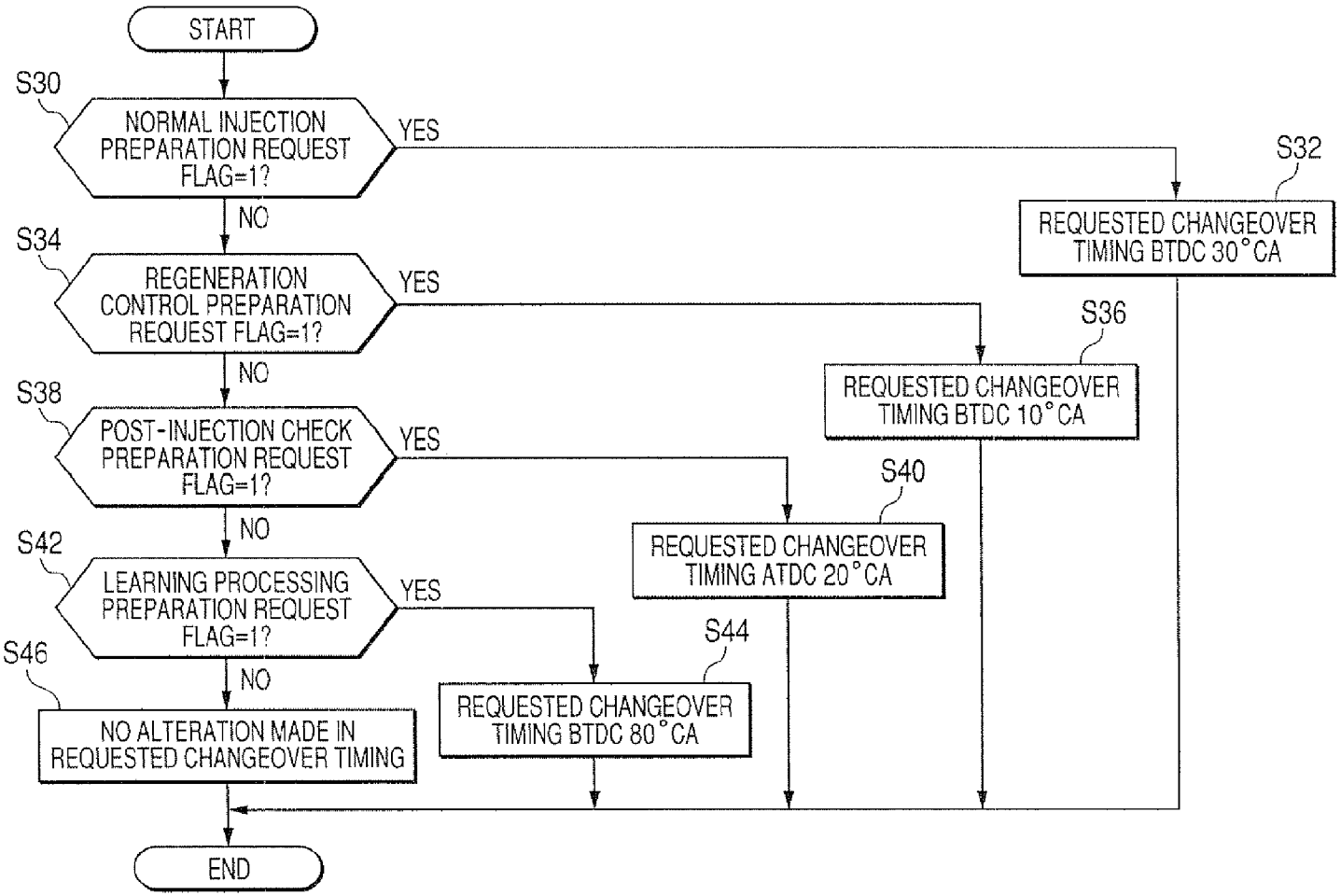
FIG. 8 is a flow diagram of a processing routine for altering a sampling interval changeover timing, with the first embodiment.

FIG. 8 is a flow diagram of a processing routine that is repetitively executed by the ECU 50 at periodic interval for setting the sampling interval changeover timings, and thereby setting the angular region timings. Firstly in step S30 a decision is made as to whether the normal injection preparation request flag is set to the 1 state, with this flag being set to 1 when a request for normal fuel injection control is generated. A request for normal fuel injection control is generated after the fuel cut-off condition of the diesel engine 10 is ended, and also when regeneration control operation is ended. If the normal injection preparation request flag is 1, then operation proceeds to step S32 in which the sampling interval changeover timing is set to be appropriate for the normal fuel injection control mode. In this case the sampling interval changeover timing is BTDC 30° CA (with reference to the compression-stroke TDC in the cylinder to which changeover is performed).

If there is a NO decision in step 30, then in S34 a decision is made as to whether the regeneration control preparation request flag is set to the 1 state, with this flag being set to 1 when a request for regeneration control is generated. A request for regeneration control is generated for example when an estimated amount of particulate matter that has accumulated within the DPR 40 exceeds a predetermined threshold value, or when the estimated amount of NOx absorbed by the NOx absorption catalyst 42 exceeds a predetermined threshold value. Various methods of determining these threshold values are known. If the regeneration control preparation request flag is found to be 1, then operation proceeds to step S36 in which the sampling interval changeover timing is set. In this case the changeover point is BTDC 10° CA (with reference to the compression-stroke TDC in the cylinder to which changeover is performed).

If there is a NO decision in step 34, then in step S38 a decision is made as to whether the post-injection check preparation request flag is set to the 1 state. This flag may become set to 1 while combustion control to perform regeneration of the DPF 40 is in progress. In performing such regeneration control, the condition shown in FIG. 7C above is sporadically established, during several angular regions or several tens of successive angular regions, for monitoring the combustion conditions resulting from the post-injections that are performed during regeneration control operation. Hence, the post-injection check preparation request flag is sporadically set to the 1 state during regeneration control operation.

It should be noted that each processing interval (i.e., succession of sensor data acquisition intervals) in the case of FIG. 7C above is preferably made only a fraction of the duration of a processing interval for the case of FIG. 7B above, for example with the ratio of the respective durations being approximately several tenths to several hundredths.

If the post-injection check preparation request flag is found to be 1 (YES decision in step S38), then operation proceeds to step S40 in which the timing for changeover of the sensor signal selected by the multiplexer 53 is set. In this case the changeover point is ATDC 20° CA, defined with reference to the compression-stroke TDC in the cylinder to which changeover is performed.

If there is a NO decision in step S38 then in step S42, a decision is made as to whether the learning preparation request flag is set to 1. This flag is set to 1 when there is a YES decision in step S10 of FIG. 5 above. If the learning preparation request flag has been set to 1, then operation proceeds to step S44 in which the sampling interval changeover timing is set. In this case the changeover timing is set as BTDC 80° CA, defined with reference to the compression-stroke TDC in the cylinder to which changeover is performed.

If there is a NO decision in step S42 (i.e., a NO decision in each of steps S30, S34, S38, S42) then step S46 is executed, to designate that there is to be no change in the sampling interval changeover timing that is applied by the multiplexer 53. Following step S32, S36, S40, S44 or S46, this execution of the processing routine is ended.

Figure 9:
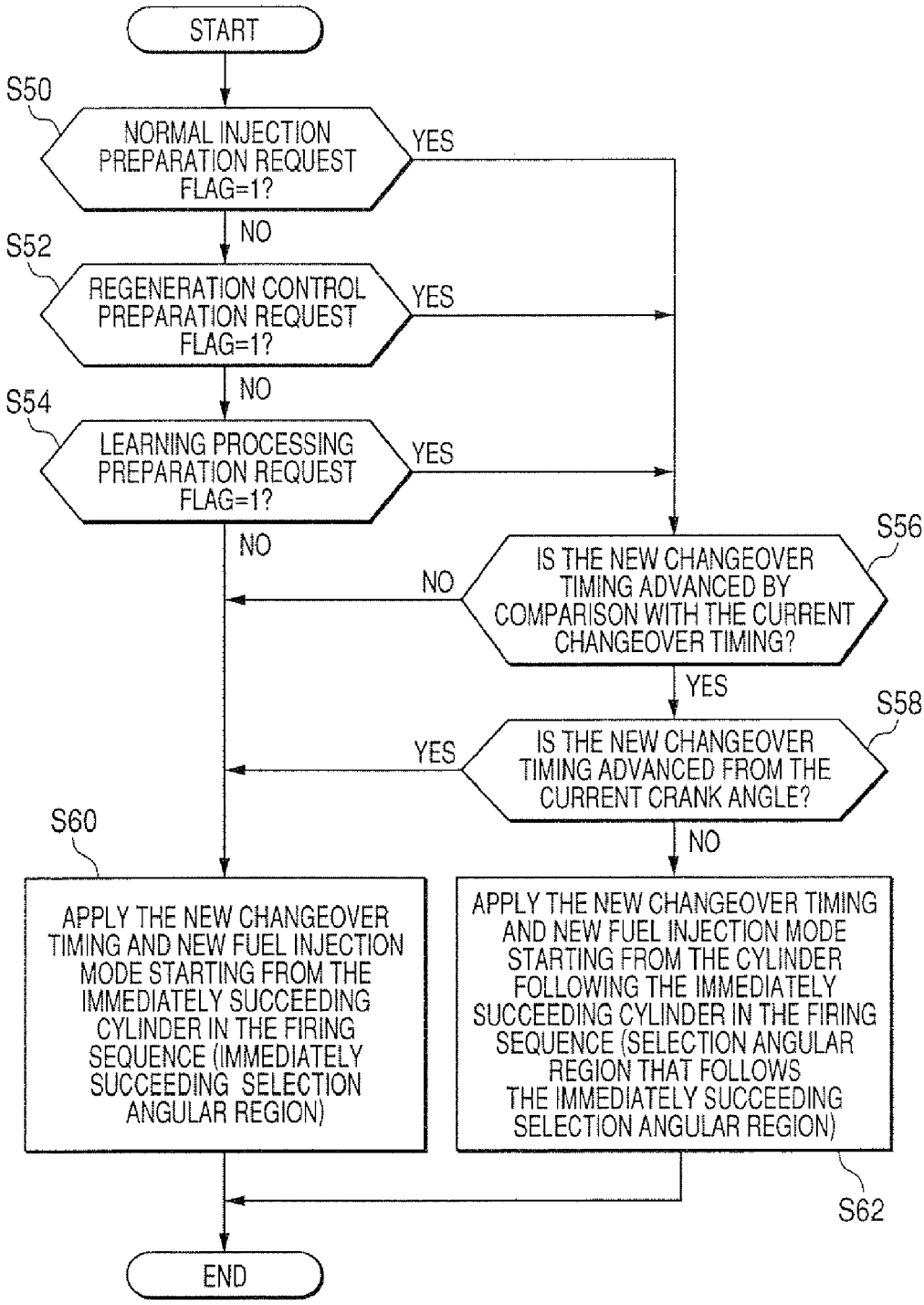
FIG. 9 is a flow diagram of a processing routine for preventing overlap between successive angular regions, when altering the sampling interval changeover timing.

FIG. 9 is a flow diagram of a processing routine executed by the ECU 50 when a change is required to be made in the sampling interval changeover timing, and the timing change is required in order to change to the normal fuel injection mode or to change to the regeneration control mode, or is required in order to execute the learning processing. The ECU 50 repetitively judges, at regular periodic intervals, whether such a change in the sampling interval changeover timing is required, and if so, the processing routine of FIG. 9 is executed.

Firstly in step S50, a decision is made as to whether the normal injection preparation request flag is set to 1. If the flag is not found to be set to 1 (NO decision) then in step S52 a decision is made as to whether the regeneration control preparation request flag is set to 1. If there is a NO decision in step S52 then a decision is made as to whether the learning preparation request flag is set to 1. If there is a YES decision in any of the steps S50, S52, S54, then operation proceeds to step S56, in which a decision is made as to whether the new sampling interval changeover timing is advanced, by comparison with the currently applied sampling interval changeover timing. If so (YES decision), this signifies that it may not be possible to acquire data for the immediately succeeding cylinder, and so operation proceeds to step S58.

In S58, a decision is made as to whether the timing of the current crank angle is advanced with respect to the new sampling interval changeover timing, and if there is a YES decision, step S60 is then executed. Step S58 is performed to judge whether the new sampling interval changeover timing cannot be implemented immediately (i.e., starting from the next cylinder in the firing sequence) due to the fact that two successive angular regions would overlap, as described in detail hereinafter.

If there is a NO decision in S58, then this signifies that it is not possible to apply the injection mode changeover commencing from the immediately succeeding one of the #A to #H cylinders. In that case, step S62 is executed, to designate that one angular region is to be skipped, so that no data will be acquired for the immediately succeeding cylinder in the firing sequence of the engine, and changing of the sampling interval changeover timing will be applied starting from the cylinder that follows the immediately succeeding cylinder in the firing sequence, as described in detail hereinafter.

If there is a NO decision in each of steps S50, S52, is S54, S56, or a YES decision in step S58, then step S60 is executed, to designate that the change of the sampling interval changeover timing is to begin from the start of the next angular region, i.e., for the immediately succeeding cylinder in the firing sequence.

Following step S60 or S62, this execution of the processing routine is ended.

FIGS. 10A, 10B, 10C, 10D are timing diagrams for describing how changes are made between injection control modes and corresponding changes in the sampling interval changeover timing. The operating principles described referring to FIGS. 10A to 10D, and also FIGS. 11A to 11D and 12A to 12D, are also applicable to the case of a change of sampling interval changeover timing in order to begin (or terminate) execution of learning processing. FIG. 10A shows changes in the state of the regeneration control preparation request flag, FIG. 10B shows the requested sampling interval changeover timing. FIG. 10C shows corresponding changes in the state of a regeneration control establishment flag, which remains at an ON level while the regeneration control injection mode is being applied. The timing diagrams of FIG. 10D show eight trains of angular regions that respectively correspond to the #A to #H cylinders.

As shown, when the regeneration control preparation request flag goes to the 1 state, so that a YES decision is reached in step S56 of FIG. 9 above, then the multiplexer 53 alters the sampling interval changeover timing that is applied for the succeeding cylinder. In the example of FIGS. 10A-10D, the regeneration control preparation request flag goes to the 1 state prior to the completion of an angular region for the #F cylinder. Hence, the sampling interval changeover timing applied for the #G cylinder (and succeeding cylinders) is changed to be appropriate for use during regeneration control operation, as described above referring to FIG. 7B, i.e., the sampling interval changeover timing is specified to be changed from BTDC 30° CA to BTDC 10° CA, with reference to compression-stroke TDC in the #G cylinder.

It can be understood that in this case there is no problem with respect to altering the sampling interval changeover timing, since the angular region for the #H cylinder (immediately following the change) will not overlap with the start of the preceding angular region for the #G cylinder. This is due to the fact that the new sampling interval changeover timing is not advanced in relation to the currently applied sampling interval changeover timing.

FIGS. 11A, 11B, 11C, 11D are timing diagrams respectively corresponding to FIGS. 10A, 10B, 10C, 10D above, for illustrating another example of such timing relationships. In this case, FIG. 11A shows changes that occur in the normal injection preparation request flag, which in this example goes to the 1 state while regeneration control operation is in progress and during an angular region corresponding to the #F cylinder. As a result, as shown in FIG. 11B, the sampling interval changeover timing is requested to be changed from BTDC 10° CA to BTDC 30° CA.

In this example, the sampling interval changeover timing is specified to be changed to a value that (if immediately applied for the succeeding cylinder, i.e., the #G cylinder) would be:

(a) advanced with respect to the sampling interval changeover timing that is currently being applied, and also (b) advanced with respect to the current crank angle (i.e., the crank angle at the time point when the normal injection preparation request flag goes to the 1 state).

Hence, as a result of condition (b) above (so that a NO decision is reached in step S58 of FIG. 9, and S62 then executed), it is not possible to immediately implement the new sampling interval changeover timing, since a selection interval corresponding to the #F cylinder would overlap a selection interval corresponding to the #G cylinder.

For that reason, sampling of the sensor signal of the immediately succeeding cylinder (#G cylinder) is not performed, and instead, the new sampling interval changeover timing is applied for the angular region of the sensor signal of the next (#H) cylinder, and changeover to the normal fuel injection mode is also postponed until the #H cylinder. Thus, the ECU 50 does not acquire sensor signal data for the #G cylinder at that time.

In that way, when changeover of the injection mode is designated but it is not possible to immediately alter the sampling interval changeover timing, data acquisition for the immediately succeeding cylinder is skipped, and the altered sampling interval changeover timing is applied starting from the next cylinder thereafter in the firing sequence.

The "skipping" of acquiring data corresponding to one angular region can be achieved by controlling the multiplexer 53 to omit selecting the cylinder pressure sensor signal of the immediately succeeding cylinder (cylinder #G in the above example), or by the ECU 50 omitting to process sample values that are derived by the A/D converter 54 for that immediately succeeding cylinder.

Another example of possible timing relationships, corresponding to FIGS. 10A, 10B, 10C, 10D above, is shown in the timing diagrams of FIGS. 12A, 12B, 12C, 12D.

In this case, the sampling interval changeover timing is specified to be changed to a value that (if immediately applied for the succeeding cylinder, i.e., the #G cylinder) is:

(a) advanced with respect to the sampling interval changeover timing that is currently being applied, but (b) is not advanced with respect to the current crank angle.

Thus in such a case it is possible to immediately apply the new sampling interval changeover timing and the new fuel injection mode, starting from the immediately succeeding cylinder (the #G cylinder). To achieve this, sampling of a cylinder pressure sensor signal (for the #F cylinder) that is currently in progress is forcibly Interrupted, thereby ensuring that overlap of successive selection intervals does not occur.

Thus with this embodiment, as can be understood from the above, changing of the injection mode and changing of the sampling interval changeover timing of the multiplexer 53 are always executed concurrently, that is to say, starting from the same cylinder in the firing sequence. Hence, when the combustion conditions within the combustion chambers 22 are temporarily unstable during a transition interval following a change of injection mode, these combustion conditions can be reliably evaluated based on the sensor signals from the cylinder pressure sensors 26*a* to 26*h*. Thus it becomes possible to achieve a sufficiently rapid control response for controlling the diesel engine 10, by feedback based on the results of evaluating the combustion condition, even during such a transition interval.

It should be noted that during such a transition interval in which the fuel combustion condition is momentarily unstable, it is preferable that the fuel injection timings and the fuel injection amounts are respectively variably controlled in a manner for optimizing the combustion conditions.

The following results are obtained with the first embodiment:

(1) The timing of the crank angle range within which digital data are acquired from each of the cylinder pressure sensors 26*a* to 26*h* is set in a variable manner, determined in accordance with the running condition of the diesel engine 10. As a result, the data acquisition range can be set to be always appropriate for monitoring the combustion conditions within the diesel engine 10, irrespective of changes made in the injection mode.

(2) The A/D converter 54 is used in common for operating on the sensor signals from all of the cylinder pressure sensors 26*a* to 26*h* of the respective #A to #H cylinders. Hence the number of hardware stages required to derive digital data from the sensor signals can be reduced.

(3) For each of the #A to #H cylinders, the A/D converter 54 performs A/D conversion of the output signal from the corresponding one of the cylinder pressure sensors 26*a* to 26*h* with a fixed period that corresponds to two complete rotations of the crankshaft 32. In addition, the A/D converter 54 performs A/D conversion of the respective sensor signals from all of the cylinder pressure sensors 26*a* to 26*h* within an interval (crank angle range) corresponding to 720/8° CA. As a result, the maximum possible amount of time is available for performed A/D conversion of the respective output signals from the cylinder pressure sensors 26*a* to 26*h*, within the limitations that are imposed by the use of the A/D converter 54 in common for all of the cylinders of the diesel engine 10.

(4) The crank angle range within which A/D conversion is performed for each of the cylinder pressure sensors 26*a* to 26*h* is varied in accordance with whether the regeneration control mode of fuel injection is being applied. Hence it becomes possible to effectively evaluate the combustion conditions in the diesel engine 10 irrespective of whether or not regeneration control is being applied.

(5) When the regeneration control fuel injection mode is being applied, the crank angle range within which A/D conversion is performed for each of the cylinder pressure sensors 26*a* to 26*h* is delayed by comparison with the crank angle range during normal engine control operation. As a result, the combustion condition can be effectively monitored, irrespective of whether or not regeneration control is being applied.

(6) When the regeneration control fuel injection mode is being applied, the crank angle range within which A/D conversion is performed for each of the cylinder pressure sensors 26*a* to 26*h* is sporadically changed between the range shown in FIG. 7B (i.e., starting at BTDC 10° CA) and the range shown in FIG. 7C (starting at ATDC 20° CA), which is substantially delayed with respect to the range shown in FIG. 7B. This enables the combustion condition within the combustion chamber 22 resulting from the above-described post-injections to be effectively monitored, further enabling the combustion condition to be effectively monitored.

(7) When the injection mode is to be changed, and it thereby becomes necessary to advance the sampling changeover timings (with respect to the timings currently being utilized), changeover of the injection mode is synchronized with changeover of that sampling changeover timings. As a result, the combustion condition can be suitably monitored even during an interval immediately following the injection mode changeover.

(8) The crank angle range within which digital data are acquired from each of the cylinder pressure sensors is varied in accordance with whether or not learning processing (for learning the output characteristics of the cylinder pressure sensors as described above) is being performed. As a result, the combustion condition can be suitably monitored while such learning processing is in progress, and combustion condition information for use in the learning processing can be appropriately acquired.

(9) When processing for learning the output characteristics of the cylinder pressure sensors is being performed, the crank angle range within which digital data are acquired from each of the cylinder pressure sensors is advanced by comparison with the crank angle used during normal fuel injection control. Combustion condition information for use in the learning processing can thereby be appropriately acquired.

Figure 13:
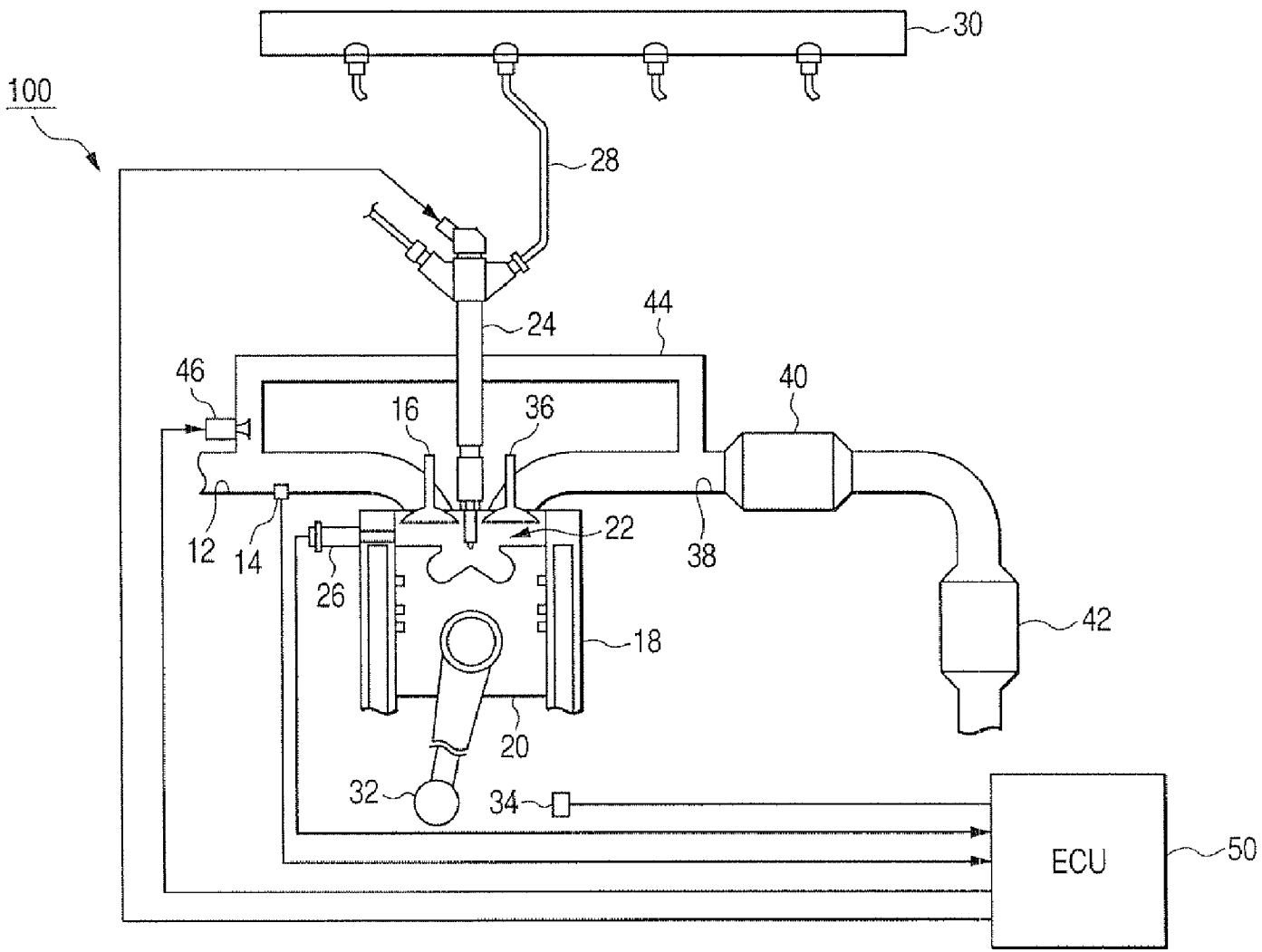
FIG. 13 shows the overall configuration of a second embodiment of an engine system.

A second embodiment will be described, with the description being centered on points of difference from the first embodiment. FIG. 13 is a diagram corresponding to FIG. 1, showing an engine system incorporating the second embodiment, with the engine system based on a 4-cylinder diesel engine 100. In FIG. 13, components corresponding to components in FIG. 1 are designated by corresponding reference numerals to those of FIG. 1.

Figure 14:
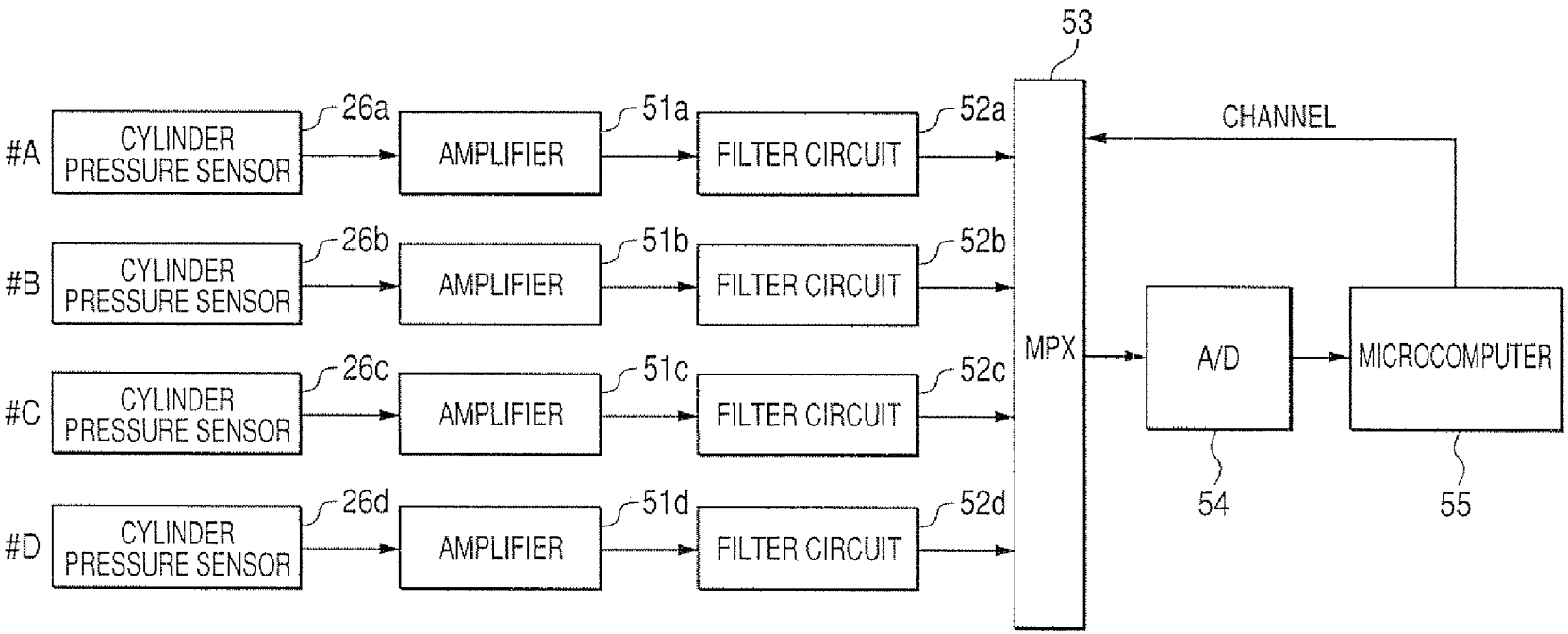
FIG. 14 is a block diagram showing the internal configuration of an ECU of the second embodiment.

FIG. 14 is a timing diagram corresponding to FIG. 2 above, in which output signals from a set of four cylinder pressure sensors 26*a* to 26*d* of this embodiment, respectively corresponding to the #A to #D cylinders of the diesel engine 100 (with the firing sequence of the engine being from the #A to #D cylinder) are supplied to a respectively corresponding ones of a set of eight amplifiers 51*a* to 51*d* in the ECU 50. The ECU 50 also includes a set of four filter circuits 52*a* to 52*d* which receive respective output signals from the amplifiers 51*a* to 51*d*, with the filter circuit output signals being successively selected by the multiplexer 53 for A/D conversion as described for the first embodiment.

Since the diesel engine 100 is a 4-cylinder engine, the output signals from each of the cylinder pressure sensors 26*a* to 26*d* can be sampled for A/D conversion during an angular region whose extent is 180° CA, with these output signals being converted in succession, as for the first embodiment. Hence, in each 4-stroke cycle of a cylinder, a substantially longer angular region is available for acquiring the pressure information for the cylinder, by comparison with the first embodiment. However it is still difficult to satisfactorily acquire the pressure information if the sampling interval changeover timing for each cylinder is held fixed irrespective of the injection mode that is being applied.

Hence with this embodiment as for the first embodiment, the sampling interval changeover timings are adjusted in accordance with the engine running condition, i.e., in accordance with the fuel injection mode that is currently being applied.

Figure 15A:
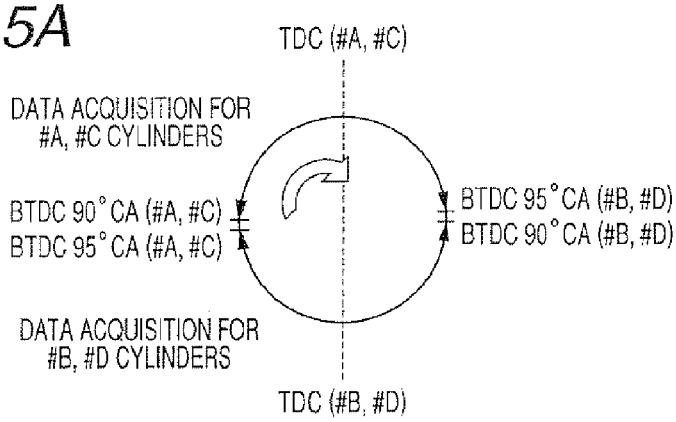
FIGS. 15A and 15B are diagrams illustrating crank angle ranges constituting angular regions, with the second embodiment.
Figure 15B:
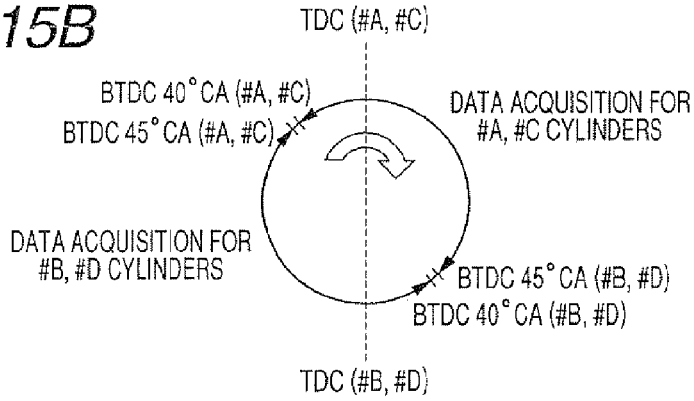

For reasons described in the following, the sampling interval changeover timing is changed only between normal fuel injection control and regeneration control operation, with this embodiment. FIGS. 15A, 15B are diagrams of the form of FIGS. 7A to 7D above, respectively showing the sampling Interval changeover timings for the case of normal fuel injection control and regeneration control operation of the diesel engine 100. As for the first embodiment, each sampling interval changeover timing (crank angle value) and angular region (crank angle range) is specified with respect to compression-stroke TDC of the cylinder concerned. With this embodiment, the angular region (A/D conversion interval) used in normal fuel injection control has a range of 720/4° CA, with the sampling interval changeover timing being BTDC 95° CA. Thus the angular region extends from BTDC 95° CA to ATDC 85° CA. This contains the range from BTDC 75° CA to TDC. Hence, the crank angle range that must be monitored for evaluating the combustion conditions during execution of learning processing and the crank angle range that must be monitored during normal fuel injection control are contained within the single range from BTDC 95° CA to ATDC 85° CA, so that the same sampling interval changeover timing can be utilized both during normal fuel injection control and learning processing.

Hence, with the 5° CA guard band being applied as described above for the first embodiment, the data acquisition range during normal fuel injection control of the diesel engine 100 is from BTDC 90° CA to ATDC 85° CA. This enables combustion conditions within each combustion chamber 22 to be suitably monitored during both normal fuel injection control and execution of learning processing.

During the regeneration control fuel injection mode, as shown in FIG. 15B, the angular region (A/D conversion interval) has a range of 720/4° CA, with the sampling interval changeover timing being BTDC 45° CA, i.e., the angular region extends from BTDC 45° CA to ATDC 135° CA.

Hence, with the 5° CA guard band being applied as described above for the first embodiment, the data acquisition range during regeneration control of the diesel engine 100 is from BTDC 40° CA to ATDC 135° CA, and so is delayed by comparison with the data acquisition range that is used during normal fuel injection control or during learning processing, shown in FIG. 15A. This delay enables combustion conditions within each combustion chamber 22 to be suitably monitored while regeneration control is being applied to the diesel engine 100.

Figure 16:
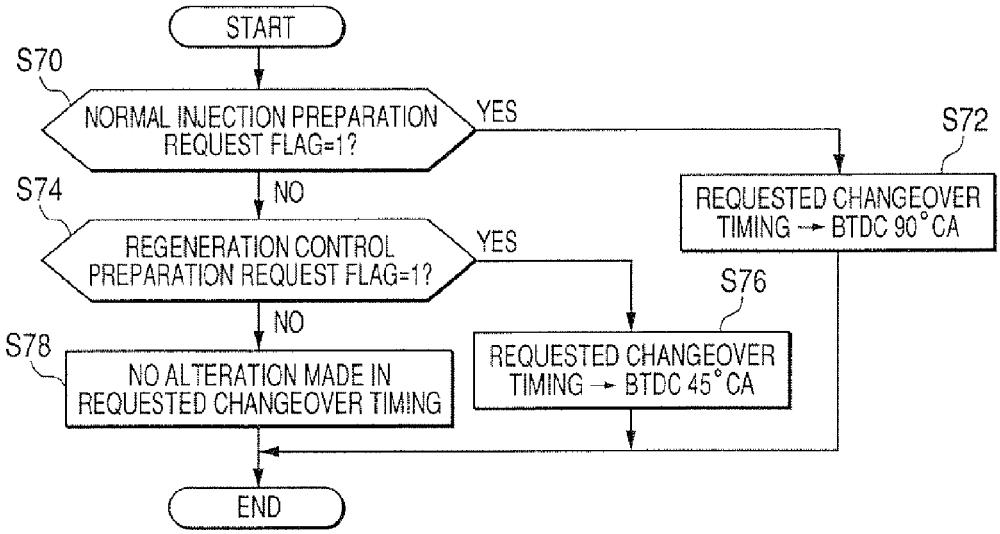
FIG. 16 is a flow diagram of a processing routine for altering the sampling interval changeover timing, with the second embodiment.
Figures 17A, 17B, 17C, 17D:
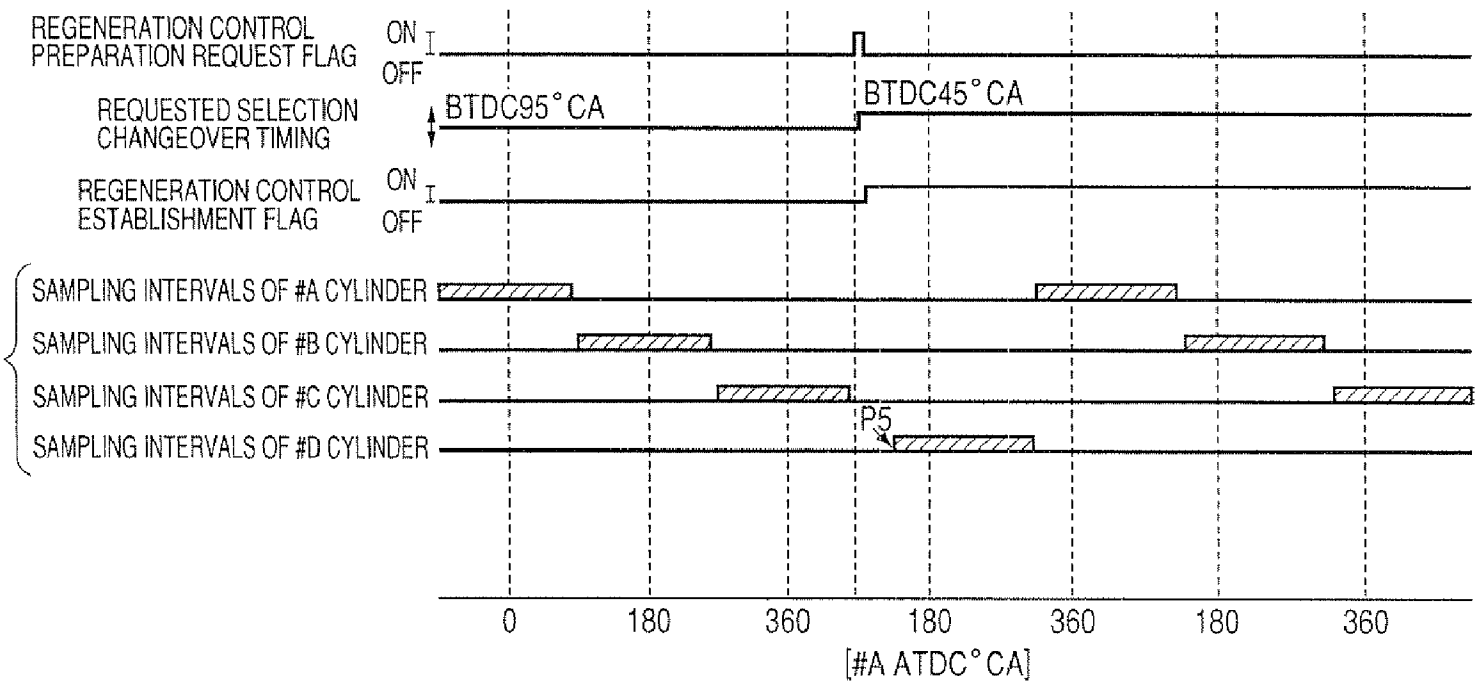
FIGS. 17A, 17B, 17C and 17D are timing diagrams for describing changing of the fuel injection mode and corresponding changing of the sampling interval changeover timing, with the second embodiment.
Figures 18A, 18B, 18C, 18D:
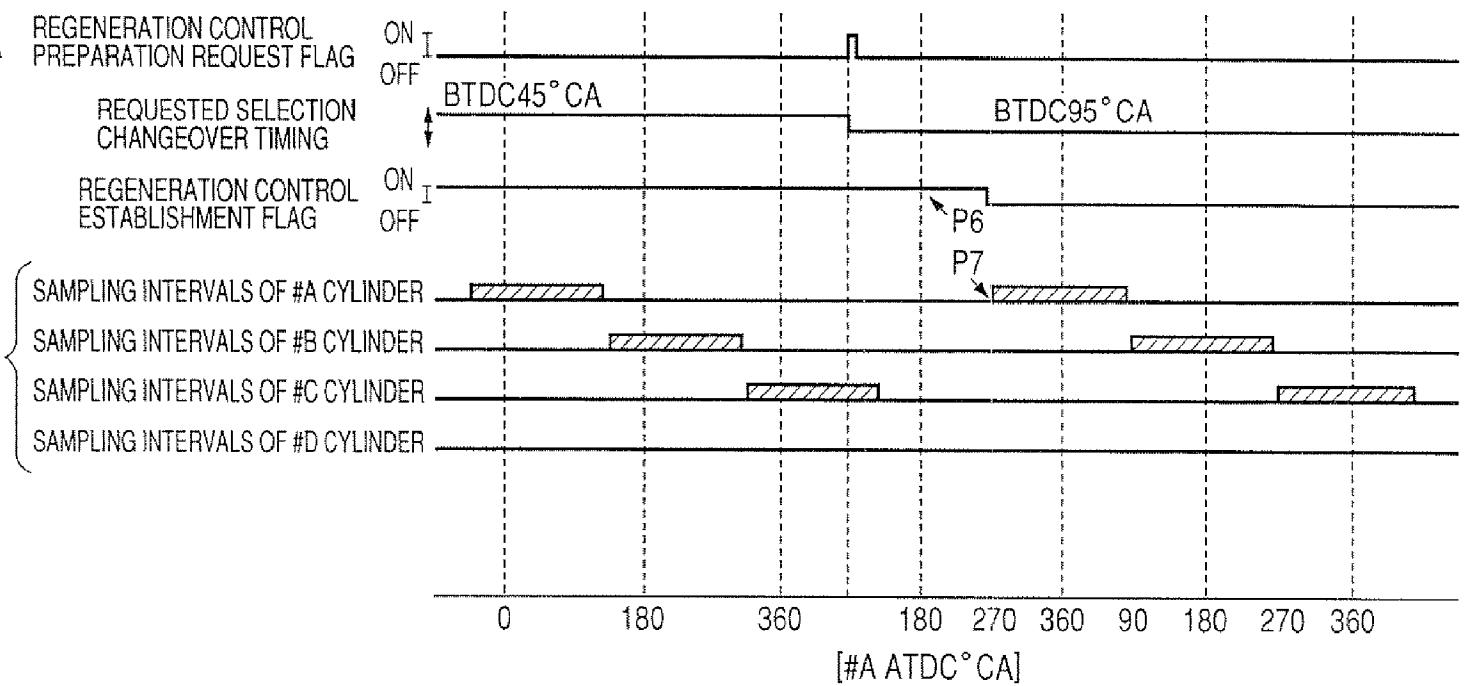
Figures 19A, 19B, 19C, 19D:
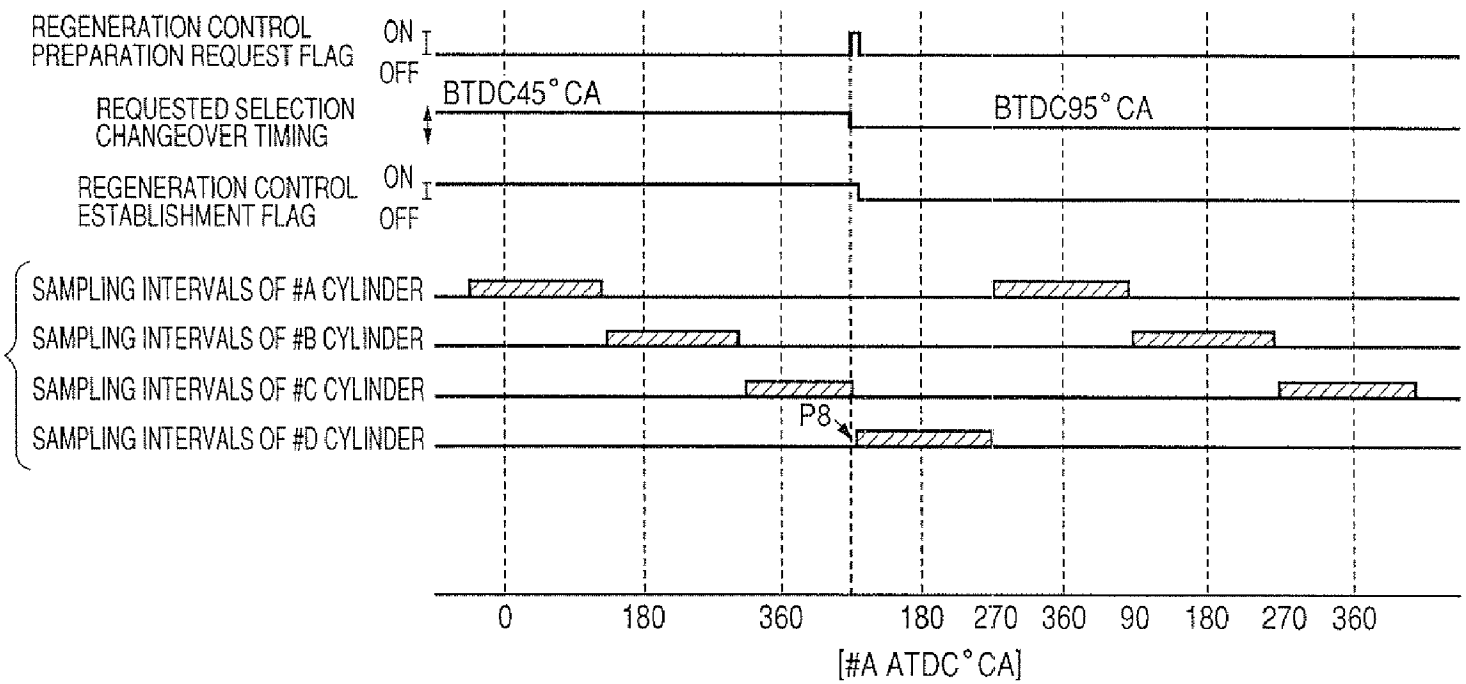

FIG. 16 is a flow diagram of a processing routine that is executed by the microcomputer 55 of this embodiment, for setting the sampling interval changeover timings that are applied by the multiplexer 53 of this embodiment. This routine is repetitively executed at periodic intervals by the microcomputer 55.

Firstly in step S70 a decision is made as to whether the normal injection preparation request flag is set to 1. With this embodiment, the normal injection preparation request flag is set to 1 either when a request for normal fuel injection control is generated, or when fuel cut-off operation is in progress (i.e., corresponding to a YES decision in step S10 of FIG. 5 above for the first embodiment) so that it is possible to execute learning processing, if necessary. If the normal injection preparation request Flag is 1 (YES decision in step S70), then in step S32 the sampling interval changeover timing is set to the value that is appropriate for normal fuel injection control and for learning processing, i.e., BTDC 90° CA.

If there is a NO decision in step S70, operation proceeds to step S74 in which a decision is made as to whether the regeneration control preparation request flag is set to the 1 state. With this embodiment, the conditions for the regeneration control preparation request flag being set to 1 are identical to those for the first embodiment described above. If there is a YES decision in step S74, then in step S76 the sampling interval changeover timing is set to the value that is appropriate for regeneration control operation, i.e., BTDC 45° CA.

If there is a NO decision in step S74, then step S74 is executed, to designate that there is to be no change in the sampling interval changeover timing that is applied by the multiplexer 53. Following step S72, S76, or S78, this execution of the processing routine is ended.

With this embodiment, when the fuel injection mode is to be changed to the normal mode (or learning processing is to be started), or is to be changed to the regeneration control injection model and the sampling interval changeover timing is to be altered accordingly, the processing of FIG. 9 above is executed to thereby prevent overlap between successive angular regions as described for the first embodiment.

Operations for changing the sampling interval changeover timing are illustrated in the timing diagrams of FIGS. 17A to 17D, FIGS. 18A to 18D, and FIGS. 19A to 19D, which respectively correspond to FIGS. 10A to 10D, FIGS. 11A to 11D, and FIGS. 12A to 12D described above for the first embodiment.

It can thus be understood that this embodiment provides the same effects as described for the first embodiment.

ALTERNATIVE EMBODIMENTS

The following modifications to the above embodiments can be envisaged.

(1) With the above embodiments, when the fuel injection mode is to be changed and the sampling interval changeover timing is to be changed accordingly, the new fuel injection mode and new sampling interval changeover timing are applied starting from the immediately succeeding cylinder only if:

(a) the new sampling interval changeover timing is not advanced by comparison with the currently applied sampling interval changeover timing (as in the example of FIGS. 10A-D), or (b) the new sampling interval changeover timing is advanced by comparison with the currently applied sampling interval changeover timing, but the current crank angle (i.e., at the point when the changeover is requested) is advanced with respect to the new sampling interval changeover timing (as in the example of FIGS. 12A-D).

However it may be preferable to apply the additional condition that the new fuel injection mode and new sampling interval changeover timing will not be applied starting from the immediately succeeding cylinder if it is not actually permissible to immediately initiate the new fuel injection mode. For example referring to FIGS. 10A-D, if the regeneration control preparation request flag were to change from the OFF to the ON level at a point shortly after the end of the angular region shown for the #F cylinder, then an initial part of the next angular region of the #G cylinder could occur before the injection mode changeover has been initiated. Thus it is possible that, for example, an extraneous pilot injection would applied to the #G cylinder, before the first angular region (with the regeneration control mode applied) for that cylinder subsequently begins at the new (delayed) changeover timing.

Hence the embodiments could be modified to ensure that when such a possibility arises, the changeover of the fuel injection mode and of the sampling interval changeover timing are each postponed until the next angular region of the cylinder which follows the immediately succeeding cylinder in the firing sequence (e.g., postponed until the #H cylinder, in the example of FIGS. 11A-D).

(2) With the first embodiment, learning processing of the output characteristics of the cylinder pressure sensors 26*a* to 26*h* is executed only during a fuel cutoff condition. However the invention is not limited to this, and it would be equally possible to perform such learning processing while the engine is running with fuel being injected into the combustion chambers. However in that case, each angular region would be advanced with respect to the point at which combustion begins in a combustion chamber, so that the corresponding cylinder pressure sensor signal would be selected only during an interval prior to the start of combustion in the combustion chamber. If that is done, then for example it would be possible to perform the learning processing while the engine is operated in the normal fuel injection control mode, if the combustion condition is stable.

(3) The invention is not limited to the use of a single A/D converter 54 in common for the sensor signals of all of the cylinders of the engine. It would be equally possible to provide respective A/D converters for each of the cylinders, with the respective outputs from the A/D converters being selected by a multiplexer, to be supplied to the microcomputer 55. In that case, the timing of each angular region would be determined by control applied to the multiplexer by the microcomputer 55, based on the running condition of the engine as for the first and second embodiments above.

(4) The invention is not limited to a system in which each of the engine cylinders is provided with a cylinder pressure sensor. In the case of an 8-cylinder engine, it would be possible to provide cylinder pressure sensors only in each of the #A, #C, #E and #G cylinders, for example. In that case the extent of each angular region could be increased to 180° CA, i.e., the same as for a 4-cylinder engine. Hence in such a case, the sampling interval changeover timings applied to the cylinder pressure sensor signals of the #A, #C, #E and #G cylinders of the 8-cylinder engine are preferably set in the same manner as described for the #A, #B, #C and #D cylinders of the diesel engine 100 of the second embodiment above, for the same reasons as described for the second embodiment.

(5) The invention is not limited to the case of a 4-cylinder or 8-cylinder internal combustion engine. Moreover the invention is not limited to the case of a diesel engine, and would be equally applicable to a gasoline internal combustion engine for example.

What is claimed is:

1. A control apparatus for a multi-cylinder internal combustion engine, comprising at least two cylinder pressure sensors respectively coupled to corresponding cylinders of said multi-cylinder internal combustion engine, with each said cylinder pressure sensor adapted to detect values of combustion chamber pressure of said corresponding cylinder, and processing circuitry adapted to acquire digital data as combustion chamber pressure data for each of said cylinders, from detection results of said corresponding cylinder pressure sensor, within each angular region of a specific series of angular regions that correspond to said cylinder and that are part of a continuous non-overlapping sequence of angular regions, each of said angular regions corresponding to a rotation of an output shaft of said multi-cylinder internal combustion engine through a specific angular displacement;

wherein said control apparatus comprises timing adjustment circuitry adapted to set a timing of each of said angular regions in accordance with a current operating condition of said multi-cylinder internal combustion engine, said timing being determined for each of said angular regions with respect to a reference position of a piston of said corresponding cylinder.

2. A control apparatus as claimed in claim 1, wherein:

said cylinder pressure sensors produce respective sensor signals as analog signals and said control apparatus comprises an A/D (analog to digital) converter circuit and a signal selector circuit controlled by said timing adjustment circuitry for selecting one of said sensor signals to be converted to digital signal form by said A/D converter circuit, with changeover of selection of successive sensor signals occurring at a sampling interval changeover timing; and said timing adjustment circuitry is adapted to set said timing of said angular regions as said sampling interval changeover timing, and to determine said sampling interval changeover timing in accordance with said current operating condition of said multi-cylinder internal combustion engine.

3. A control apparatus as claimed in claim 1, wherein:

for each of said cylinders, said combustion chamber pressure data are acquired from said detection results in each of periodically occurring intervals, with a period corresponding to two rotations of said engine output shaft, and an extent of each of respective intervals in which said conversion is applied, for each of said sensor signals, corresponds to two complete rotations of said engine output shaft divided by a total number of said cylinders of said multi-cylinder internal combustion engine.

4. A control apparatus as claimed in claim 1, comprising a plurality of fuel injection devices coupled to respective ones of said cylinders, and fuel injection control circuitry adapted to control said fuel injection devices for supplying fuel to said combustion chambers, wherein said timing adjustment circuitry sets said timing of said angular regions in accordance with a fuel injection control mode that is currently applied by said fuel injection control circuitry.

5. A control apparatus as claimed in claim 4, wherein:

said multi-cylinder internal combustion engine comprises an exhaust system, and an exhaust gas cleansing device installed in said exhaust system;

said fuel injection control circuitry is operable for selectively establishing a normal fuel injection mode and a regeneration control mode, said regeneration control mode being appropriate for effecting regeneration of said exhaust gas cleansing device, and said timing adjustment circuitry is adapted to selectively set said timing of said angular regions in accordance with whether or not said regeneration control mode is established.

6. A control apparatus as claimed in claim 5, wherein while said regeneration control mode is established, said timing of said angular regions is adjusted to become delayed by comparison with a value of said timing during with operation in said normal fuel injection mode.

7. A control apparatus as claimed in claim 6, wherein when said regeneration control mode becomes established, said timing adjustment circuitry is adapted to set said timing of said angular regions at a first value, and to thereafter sporadically set said each timing at a second value that is delayed by comparison with said first value.

8. A control apparatus as claimed in claim 4, wherein when a change to a new fuel injection control mode and a corresponding change to a new value of timing of said angular regions are required to be made, said fuel injection control circuitry and said timing adjustment circuitry are adapted to apply said change to the new fuel injection control mode and said change to the new value of timing concurrently.

9. A control apparatus as claimed in claim 4, wherein under a condition that a change to a new fuel injection control mode, and a corresponding change to a new value of timing of said angular regions, are required to be made, while, said new value of said timing of the angular regions is more advanced than a currently established value of said timing, and a current angular position of said output shaft corresponds to a timing that is more advanced than said new value of timing of the angular regions, said fuel injection control circuitry and said timing adjustment circuitry are adapted to apply said change to said new fuel injection control mode and said change to said new value of timing of the angular regions concurrently, for a cylinder that is an immediately succeeding cylinder in a firing sequence of said multi-cylinder internal combustion engine.

10. A control apparatus as claimed in claim 4, wherein under a condition that a change to a new fuel injection control mode, and a corresponding change to a new value of timing of said angular regions, are required to be made, while, said new value of said timing of the angular regions is more advanced than a currently established value of said timing, and a current angular position of said output shaft corresponds to a timing that is not more advanced than said new value of timing of the angular regions, said fuel injection control circuitry and said timing adjustment circuitry are adapted to apply said change to said new fuel injection control mode and said change to said new value of timing of the angular regions concurrently, for a cylinder which follows an immediately succeeding cylinder in a firing sequence of said multi-cylinder internal combustion engine.

11. A control apparatus as claimed in claim 1, wherein:

said control apparatus comprises learning processing circuitry adapted to perform processing for learning respective deviations of output characteristics of said cylinder pressure sensors, and said timing adjustment circuitry is adapted to selectively alter said timing of said angular regions in accordance with whether or not said learning processing is being performed.

12. A control apparatus as claimed in claim 11, wherein while said learning processing is being performed, said timing adjustment circuitry is adapted to delay said timing of said angular regions, by comparison with said timing while said learning processing is not being performed.

13. A control apparatus as claimed in claim 1, wherein:

said cylinder pressure sensors produce respective sensor signals as analog signals and said control apparatus comprises a plurality of A/D (analog to digital) converter circuits each adapted to convert a corresponding one of said sensor signals to a digital signal, and a signal selector circuit controlled by said timing adjustment circuitry for selecting one of said digital signals produced from said A/D converter circuits; and said timing adjustment circuitry is adapted to determine said timing of said angular regions by setting a sampling interval changeover timing applied by said signal selector circuit, said sampling interval changeover timing being determined in accordance with said current operating condition of said multi-cylinder internal combustion engine.

* * * * *